US006497384B1

(12) United States Patent
Fujiwara et al.

(10) Patent No.: US 6,497,384 B1
(45) Date of Patent: Dec. 24, 2002

(54) METHOD OF AND APPARATUS FOR WINDING FILM, METHOD OF AND APPARATUS FOR SUPPLYING FILM ROLL CORE, AND METHOD OF AND APPARATUS FOR INSPECTING APPEARANCE OF FILM ROLL

(75) Inventors: Takayuki Fujiwara, Minamiashigara (JP); Tomohiro Nakata, Minamiashigara (JP); Katsuhiro Sugiyama, Minamiashigara (JP); Yuji Okabe, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 142 days.

(21) Appl. No.: 09/598,293

(22) Filed: Jun. 21, 2000

(30) Foreign Application Priority Data

Jun. 22, 1999 (JP) ..... 11-175981
Jun. 28, 1999 (JP) ..... 11-182324
Aug. 3, 1999 (JP) ..... 11-220033

(51) Int. Cl.[7] ..... B65H 19/30
(52) U.S. Cl. ..... 242/533.1; 242/527
(58) Field of Search ..... 242/527, 533, 242/533.1, 532.7, 527.1, 532

(56) References Cited

U.S. PATENT DOCUMENTS 4,676,448 A * 6/1987 Kofler ..... 242/533
4,965,931 A * 10/1990 Suzuki et al. ..... 242/530
5,275,348 A * 1/1994 Looser
5,308,217 A * 5/1994 Pienta ..... 242/533
5,868,340 A * 2/1999 Araki et al. ..... 242/532.7
6,260,786 B1 * 7/2001 Ueyama ..... 242/533

FOREIGN PATENT DOCUMENTS

| | | |
|---|---|---|
| JP | 5-17058 | 1/1993 |
| JP | 6-24649 | 2/1994 |
| JP | 7-53547 | 6/1995 |
| JP | 7-304567 | 11/1995 |
| JP | 9-58930 | 3/1997 |
| JP | 10-25043 | 1/1998 |
| JP | 10-53360 | 2/1998 |

OTHER PUBLICATIONS

Patent Abstract of Japan 06234444 Aug. 23, 1994.
Patent Abstract of Japan 10025043 Jan. 27, 1998.
Patent Abstract of Japan 10053360 Feb. 24, 1998.
Patent Abstract of Japan 05017058 Jan. 26, 1993.
Patent Abstract of Japan 06024649 Feb. 1, 1994.
Patent Abstract of Japan 07304567 Nov. 21, 1995.
Patent Abstract of Japan 09058930 Mar. 4, 1997.

* cited by examiner

*Primary Examiner*—William A. Rivera
(74) *Attorney, Agent, or Firm*—Sughrue Mion, PLLC

(57) ABSTRACT

A film winding apparatus has a film winding mechanism for rotating a roll core to wind an elongate film around the roll core thereby to produce a film roll, a product receiving mechanism for gripping the film roll while tensioning the elongate film, the product receiving mechanism being displaceable away from the film winding mechanism, and a cutting mechanism for transversely cutting off the elongate film while the elongate film is being tensioned by the product receiving mechanism. The elongate film can be wound highly accurately around the roll core with a simple process and arrangement.

24 Claims, 39 Drawing Sheets

METHOD OF AND APPARATUS FOR WINDING FILM, METHOD OF AND APPARATUS FOR SUPPLYING FILM ROLL CORE, AND METHOD OF AND APPARATUS FOR INSPECTING APPEARANCE OF FILM ROLL

BACKGROUND OF THE INVENTION

1. Field of the Invention

The present invention relates to a method of and an apparatus for winding a film, a method of and an apparatus for supplying a film roll core, and a method of and an apparatus for inspecting the appearance of a film roll, which are applied to a film rewinder or a film cutter to wind a film around a roll core.

2. Description of the Related Art

Generally, film rewinders for automatically winding a film around a core or film cutters for cutting a wider film into a narrower film and automatically winding the narrower film around a core employ an arrangement for cutting an elongate film upstream of a film winding station and thereafter feeding the cut film length to the film winding station. For details, reference should be made to Japanese laid-open patent publication No. 10-25043, for example.

According to the above process, the leading end of the cut film is in a free state and is not controlled. Therefore, the film tends to undulate and it is difficult to align an edge of the film at a constant position with an end of a roll core. For example, rolls of photosensitive material such as print paper have a film edge whose shape is highly important for film quality. If a film edge projects axially outwardly from an end of the roll core, then the projecting film edge tends to be damaged while the film is packaged or delivered.

Various proposals have been made to wind a film around a core highly accurately with simple and inexpensive arrangements. For example, Japanese patent publication No. 7-53547 and Japanese laid-open patent publication No. 10-53360 disclose apparatus in which a product with a wound film is discharged using a vertically movable product receiver, then a new core is supplied, and the film is cut while the film is being nipped by the supplied core and a touch roller.

According to the above proposed structures, while the product is being lowered after it has been unchucked, the film is free of any tension. Therefore, if the film passes through a displaced position, then an edge of the film projects from an end of the roll core.

The above film rewinders and film cutters have an automatic core supply device for automatically supplying a core to a circumferential edge of the film winding station and an automatic film winding device for rotating the roll core supplied from the automatic core supply device to automatically wind the film around the roll core. However, since the automatic core supply device and the automatic film winding device have their operating ranges partly interfering with each other, it is difficult to shorten the period of time after the winding of the film has been completed until a film starts being wound around a new core. This is because after the automatic core supply device has place a core in the film winding station, the automatic core supply device is sufficiently retracted from the film winding station, and then the film starts being wound around the roll core. As a result, the entire process of winding the film around the roll core cannot be speeded up, and the apparatus is complex in structure, resulting in a considerably high cost of equipment.

As disclosed in Japanese laid-open patent publication No. 5-17058, there is known a process of surrounding a new core with an endless belt in a retracted position, moving the endless belt to a winding position after the winding of a web material has been completed in the winding position, and rotating the roll core to wind a new web material therearound.

Since it is difficult to supply the roll core accurately to the winding position with the endless belt only, a member is used to fix the roll core in position. The member needs to be moved back and force by a cylinder, and a time loss is caused to retract the member with the cylinder. In addition, because of the core fixing member used, the endless belt cannot be positioned closely around the roll core fully across its axis, making it difficult to wind the film highly precisely around the roll core.

Rolled film products have end faces whose shapes are important for product quality. For example, rolled film products suffer appearance defects if a rolled film product has a concave conical end face as shown in FIG. 50 of the accompanying drawings, if a rolled film product has a convex conical end face as shown in FIG. 51 of the accompanying drawings, if a rolled film product has a film layer projecting an end face thereof as shown in FIG. 52 of the accompanying drawings, or if a rolled film product has an end face displaced wholly or partly as shown in FIG. 53 of the accompanying drawings. These appearance defects are responsible for damage to the end faces of the products while they are being packaged or delivered. Accordingly, it is necessary to inspect rolled film products for their end face configuration.

It has been customary to visually or tactually inspect rolled film products for their end face configuration. Other processes of inspecting products other than films for their appearance are disclosed in Japanese laid-open patent publications Nos. 6-24649 (first conventional process), 7-304567 (second conventional process), and 9-58930 (third conventional process).

According to the first conventional process, a parallel slit light beam emitted by an illuminating device comprising a light source and a slit is applied from a side of a spinning package to an edge thereof. The irradiated area is imaged by a CCD camera, and the image is processed to effect pattern matching for comparison with a normal package configuration.

According to the second conventional process, a strip-shaped beam of light emitted from a laser oscillator and dispersed by a cylindrical lens is applied to an edge of a yarn package. A yarn filament is raised from the package edge under electrostatic induction, and an image of the raised yarn filament captured by a CCD camera is converted into a binary image. The boundary between non-irradiated and irradiated areas of the binary image, near the non-irradiated area, is scanned by a line sensor, and compared with a threshold value having a predetermined signal width.

According to the third conventional process, laser displacement meters are vertically disposed respectively against face and back end faces of a yarn bobbin. Based on output signals from the laser displacement meters, distances up to the face and back end faces of the yarn bobbin are measured, and surface irregularities of the face and back end faces of the yarn bobbin are measured for automatically determining contour defects of the yarn bobbin.

Since the conventional processes of inspecting rolled film products for their appearance have been manually performed visually or tactually, the rolled film products cannot be evaluated objectively. Evaluation standards tend to vary from lot to lot, personnel expenses that are required are liable to be high, and the period of time required for the inspection is likely to be long, resulting in a poor productivity.

The first through third conventional processes described above are not aimed at the inspection of rolled film products. If these conventional processes are applied to the inspection of rolled film products, then inasmuch they employ commercially available laser displacement meters and light sources, inspected rolled film products may be exposed to undesirable light.

SUMMARY OF THE INVENTION

It is a general object of the present invention to provide a method of and an apparatus for winding a film highly accurately and efficiently around a core with a simple process and arrangement.

A primary object of the present invention is to provide a method of and an apparatus for supplying a film roll core to allow a film to be wound quickly and highly accurately around the film roll core, through a simple arrangement.

Another principal object of the present invention is to provide a method of and an apparatus for inspecting the appearance of a film roll accurately within a short period of time without affecting the quality of the film for effectively increasing the production efficiency.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
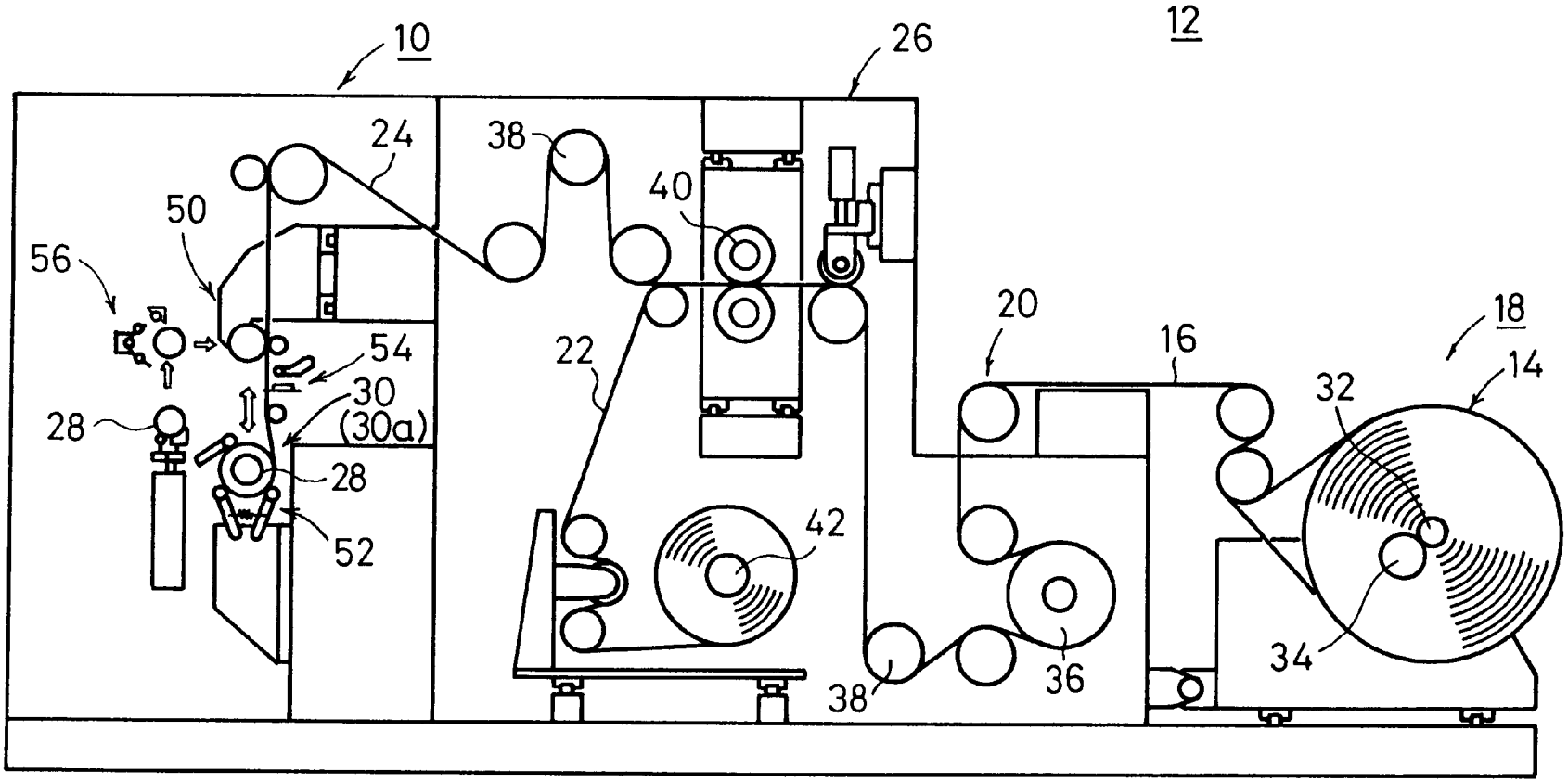
FIG. 1 is a schematic side elevational view of a film rewinder incorporating a film winding apparatus according to a first embodiment of the present invention.

FIG. 1 schematically shows a film rewinder 12 incorporating a film winding apparatus 10 according to a first embodiment of the present invention.

As shown in FIG. 1, the film rewinder 12 generally comprises a film delivery apparatus 18 for rotating a rolled photosensitive material 14 (hereinafter referred to as "film roll 14") comprising a PET film, a TAC film, a PEN film, or a print sheet or the like as a base, to unwind and deliver an elongate film 16, a feed apparatus 20 for feeding the elongate film 16 successively through subsequent processing stages, an edge cutting apparatus 26 for cutting off opposite edges 22 of the elongate film 16 fed by the feed apparatus 20 to produce an elongate film 24 having a predetermined width, and a film winding apparatus 10 for winding the elongate film 24 around a roll core 28 and thereafter cutting off the elongate film 24 to a predetermined length for thereby producing a product (film roll) 30*a*.

The film delivery apparatus 18 has a delivery shaft 32 on which the film roll 14 is supported and which is coupled to a rotary actuator (not shown) and controlled by a variable brake 34. The feed apparatus 20 has a main feed roller 36 such as a suction drum or the like and a plurality of rollers 38. The edge cutting apparatus 26 has a pair of upper and lower rotary cutters 40 and a pair of edge winding units 42 for winding the severed edges 22.

Figure 2:
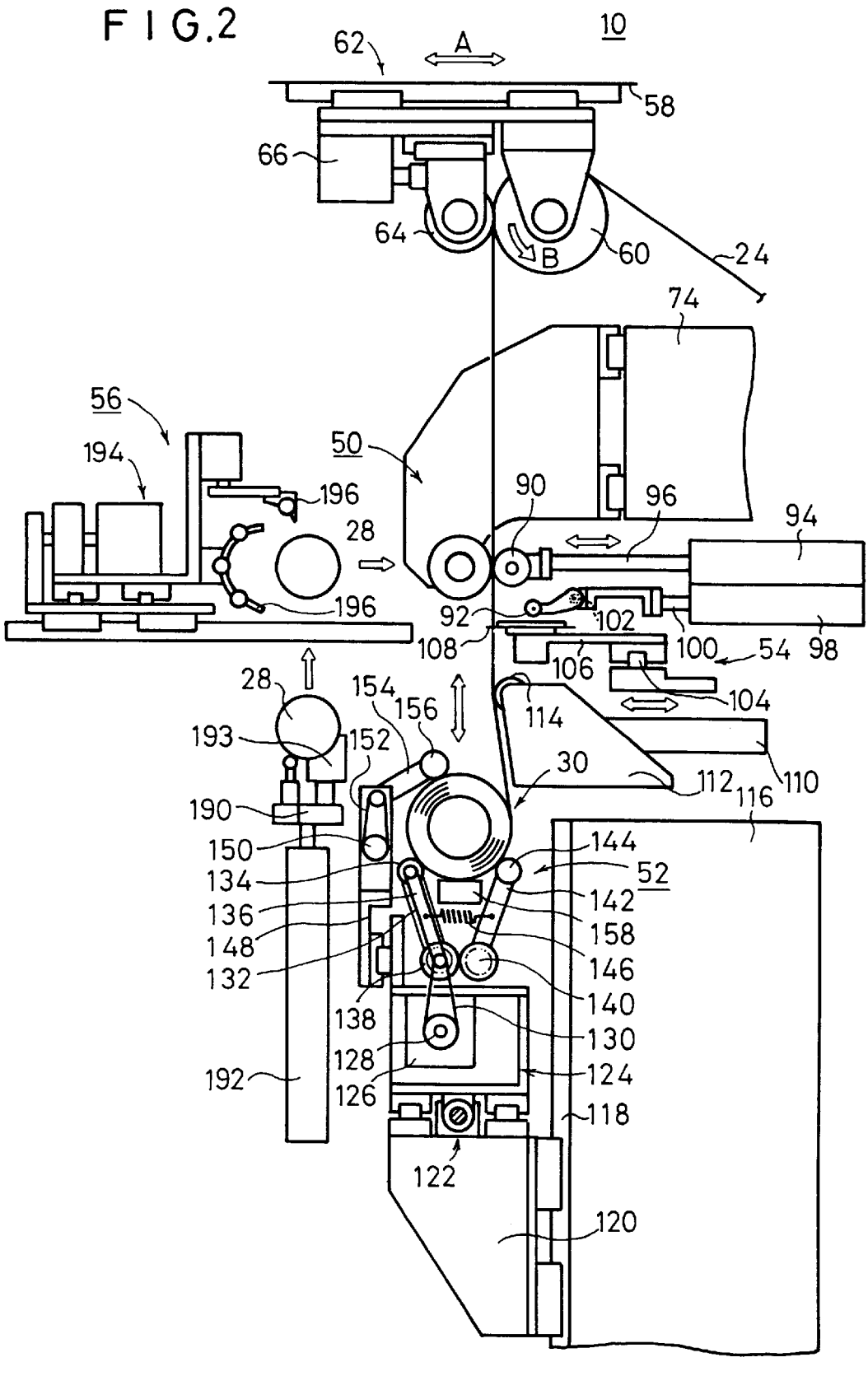
FIG. 2 is a side elevational view of the film winding apparatus.

As shown in FIG. 2, the film winding apparatus 10 comprises a film winding mechanism 50 for holding and rotating the roll core 28 to wind a predetermined length of the elongate film 24 around the roll core 28 for thereby producing a film roll 30, a product receiving mechanism 52 for gripping a circumferential surface of the elongate film 24 wound around the roll core 28 under tension, the product receiving mechanism 52 being displaceable away from the film winding mechanism 50, a cutting mechanism 54 for transversely cutting the elongate film 24 while the elongate film 24 is being tensioned by the product receiving mechanism 52, and a supply apparatus 56 for automatically supplying the roll core 28 to the film winding mechanism 50.

The film winding mechanism 50 has an upper frame 58 which supports thereon a path roller 60 that is positionally adjustable in the directions indicated by the arrow A by a slide means 62. A rotary actuator (not shown) is coupled to the path roller 60 for rotating the path roller 60 in the direction indicated by the arrow B at a peripheral speed higher than the speed at which the elongate film 24 is fed by the main feed roller 36.

A nip roller 64 is positioned for movement into and out of rolling contact with the path roller 60. The nip roller 64 can be moved toward and away from the path roller 60 by a cylinder 66. When the nip roller 64 is pressed against the path roller 60 with the elongate film 24 sandwiched therebetween, a predetermined tension is applied to the edge cutting apparatus 26 while the elongate film 24 downstream of the nip roller 64 is not being tensioned. The slide means 62, which supports the path roller 60 and the nip roller 64 thereon, is positionally adjustable in the directions indicated by the arrow A depending on different (e.g., two) core diameters.

Figure 3:
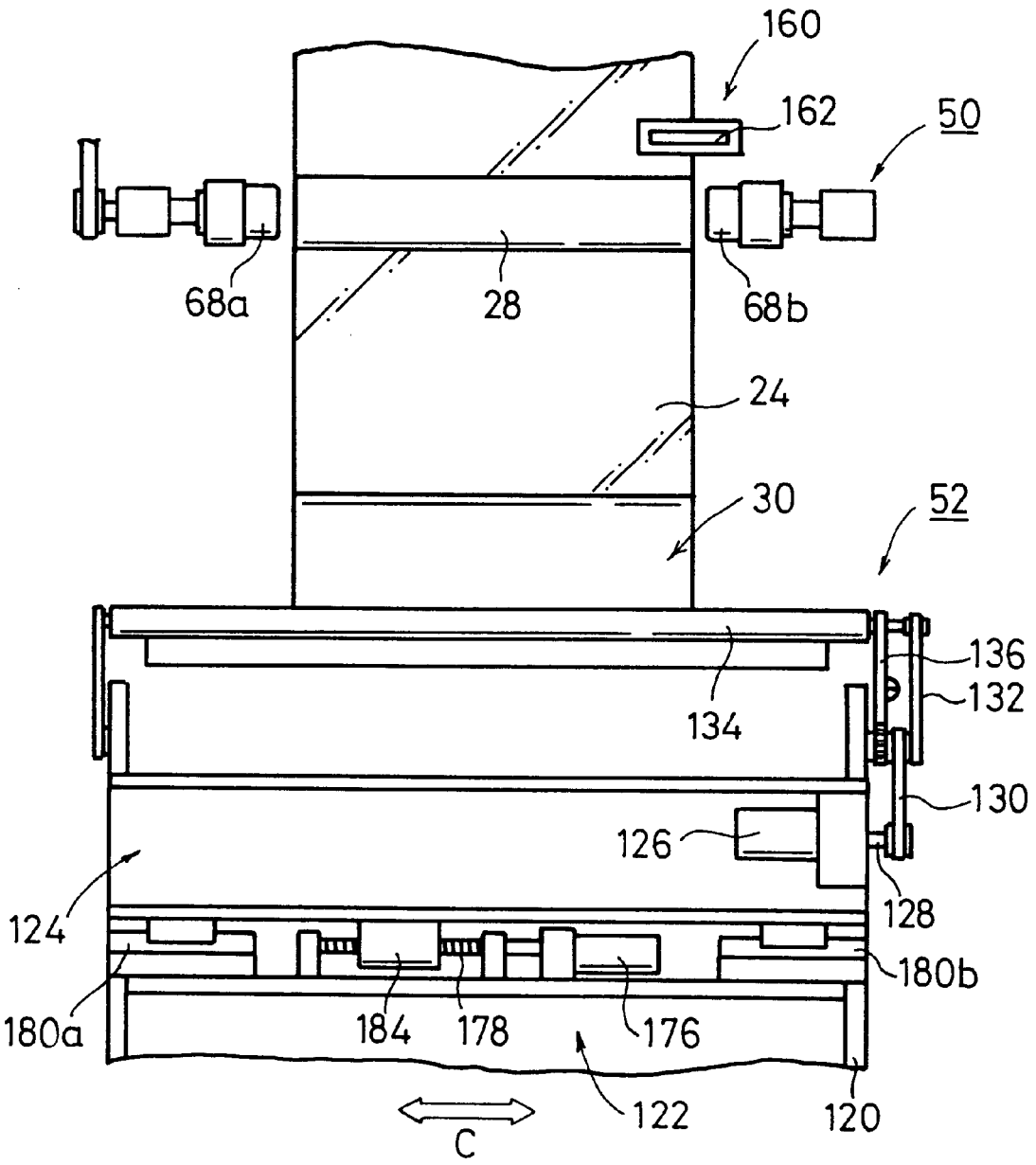
FIG. 3 is a front elevational view showing a detecting means and an automatic correcting means of the film winding apparatus.
Figure 4:
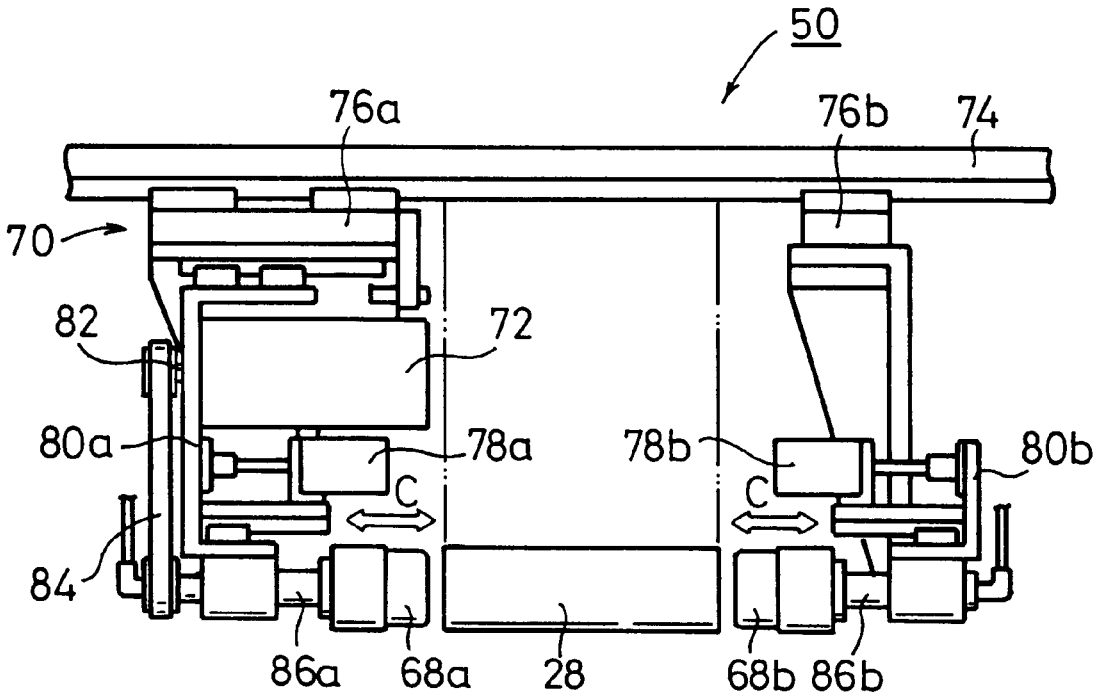
FIG. 4 is a front elevational view of a film winding mechanism of the film winding apparatus.

As shown in FIGS. 2 through 4, the film winding mechanism 50 has a pair of winding chucks 68*a*, 68*b* for holding the respective opposite ends of the roll core 28 and rotating the roll core 28. The winding chucks 68*a*, 68*b* are movable toward and away from each other in the directions indicated by the arrow C by a slide means 70. To the winding chuck 68*a*, there is connected a torque-controllable servomotor 72 for tensioning the elongate film 24 after the elongate film 24 has been wound around the roll core 28.

As shown in FIG. 4, the slide means 70 has a pair of base members 76*a*, 76*b* that is positionally adjustable along a guide rail 74. A first movable base 80a that is movable back and forth by a first cylinder 78*a* is mounted on the base member 76*a*. The first movable base 80*a* supports thereon a servomotor 72 having a drive shaft 82 that is operatively coupled to a rotatable shaft 86*a* of the winding chuck 68*a* by a belt and pulley mechanism 84. The rotatable shaft 86*a* is rotatably supported on the first movable base 80*a* by a bearing (not shown).

A second movable base 80*b* that is movable back and forth by a second cylinder 78*b* is mounted on the base member 76*b*. The winding chuck 68*b* has a rotatable shaft 86*b* rotatably supported on the second movable base 80*b* by a bearing (not shown).

As illustrated in FIG. 2, the film winding mechanism 50 also has a movable nip roller 90 for holding the elongate film 24 against the peripheral surface of a new roll core 28 when the elongate film 24 is cut off, and a movable guide roller 92 for guiding the end of the severed elongate film 24 onto the peripheral surface of the roll core 28. The nip roller 90 is rotatably supported on the tip end of a rod 96 that extends horizontally from a first drive cylinder 94. The guide roller 92 is swingably supported by a leaf spring 102 on the tip end of a rod 100 that extends horizontally from a second drive cylinder 98. The cutting mechanism 54 has a movable base 106 movable back and forth along a guide rail 104 in directions across the elongate film 24, and a disk cutter 108 rotatably mounted on the distal end of the movable base 106. The cutting mechanism 54 is disposed above a suction box 112 that is movable back and forth horizontally by a third drive cylinder 110. A path changing roller 114 is rotatably supported on an upper portion of the suction box 112. The path changing roller 114 functions to direct the elongate film 24 substantially perpendicularly to a straight line that interconnects the axis of the roll core 28 and the axis of the nip roller 90 when the elongate film 24 begins to be wound around the roll core 28.

The product receiving mechanism 52 has a lifter table 120 vertically movable along a guide rail 118 on a side surface of a base 116. The product receiving mechanism 52 also includes a main assembly 124 mounted on the lifter table 120 and movable back and forth in directions across the elongate film 24 by an automatic correcting means 122. The main assembly 124 includes a torque motor 126 having a drive shaft 128 that is operatively coupled to a tensioning roller 134 by a first belt and pulley mechanism 130 and a second belt and pulley mechanism 132. The tensioning roller 134 is drivably supported on the distal end of a first swing arm 136.

The first swing arm 136 is swingably supported on a shaft to which a first gear 138 is coaxially fixed. The first gear 138 is held in driving mesh with a second gear 140 that is coaxially fixed to the shaft of a second swing arm 142. The second swing arm 142 supports a free roller 144 rotatably on its distal end. A tension spring 146 is connected between substantially central portions of the first and second swing arms 136, 142.

A slide base 148 is mounted on a side surface of the main assembly 124 for movement in directions across the elongate film 24. A motor 150 mounted on the slide base 148 is operatively coupled to a swingable arm 154 by a belt and pulley mechanism 152, and a rider roller 156 is rotatably supported on the upper end of the arm 154. A conveyor 158 for discharging a rolled film product 30*a* is disposed between the first and second swing arms 136, 142.

As shown in FIG. 3, a detecting means 160 for detecting whether the elongate film 24 is positionally displaced in its transverse directions indicated by the arrow C or not is positioned in the vicinity of the film winding mechanism 50. The automatic correcting means 122, which serves to automatically correct the position of the elongate film 24 based on a signal from the detecting means 160, is incorporated in the main assembly 124. The detecting means 160 has a sensor 162 for detecting an edge of the elongate film 24. The sensor 162 comprises an optical sensor, e.g., an infrared sensor such as an LED, a laser, or the like.

The automatic correcting means 122 has a servomotor 176 that is controlled by a feedback signal based on a detected signal from the sensor 162. The servomotor 176 is connected to a ball screw 178 extending in the direction indicated by the arrow C and rotatably supported on the lifter table 120. The lifter table 120 supports thereon a pair of rails 180*a*, 180*b* on which the main assembly 124 is supported for back-and-forth movement in the directions indicated by the arrow C. A holder 184 is fixed to the main assembly 124 and has an internally threaded surface (not shown) that is threaded over the ball screw 178. Therefore, when the ball screw 178 rotates about its own axis, the main assembly 124 moves horizontally along the rails 180*a*, 180*b*.

As shown in FIG. 2, the supply apparatus 56 has a core support base 190 for supporting a roll core 28. The core support base 190 is vertically movable between a core receiving position and a core transferring position by a vertical cylinder 192. A suction box 193 that is connected to a vacuum source (not shown) is mounted on the core support base 190. A core feeding means 194 is disposed at the core transferring position and has a block wrapper 196 that is movable back and forth horizontally.

Figure 5:
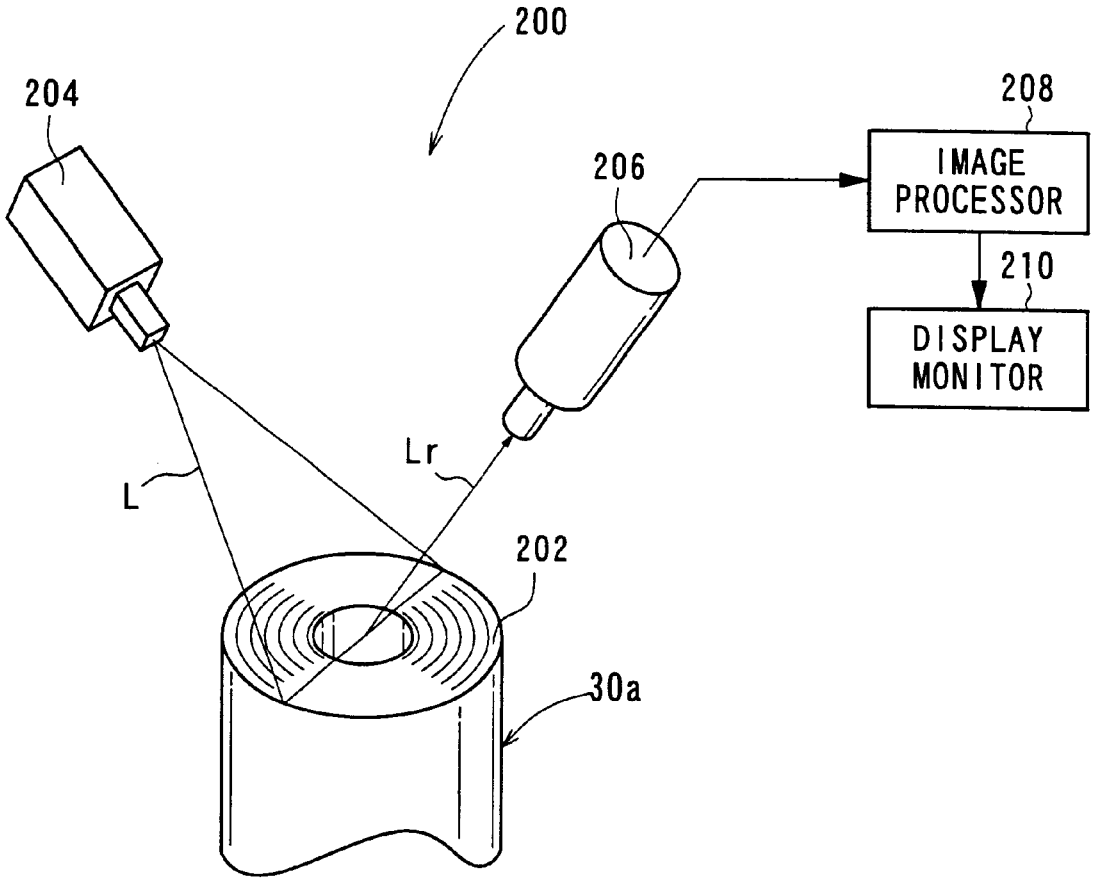
FIG. 5 is a perspective view, partly in block form, an appearance inspecting apparatus according to an embodiment of the present invention, with a photodetector being arranged to image an inspected surface obliquely.

As shown in FIG. 5, the film rewinder 12 has an appearance inspecting apparatus 200 for inspecting the appearance of the product 30*a*. The appearance inspecting apparatus 200 comprises a laser beam source (irradiating means) 204 for irradiating at least one inspected surface (end surface) 202 of the product 30*a* with a linear laser beam L (straight laser beam in the first embodiment) in a wavelength range to which the photosensitive material is not sensitive, a photodetector (imaging means) 206 for capturing an image of a reflected beam Lr from the inspected surface 202 that is irradiated with the laser beam L, and an image processor (inspecting means) 208 for inspecting whether the appearance of the product 30*a* is good or bad based on the image of the reflected beam Lr captured by the photodetector 206. To the image processor 208, there is connected a display monitor 210 for the operator to view the image of the reflected beam Lr.

The wavelength range to which the photosensitive material is not sensitive is upward from 900 nm. The photodetector 206 may comprises a black-and-white CCD television camera which is sensitive to a near-infrared range. As shown in FIG. 5, the inspected surface 202 of the rolled film product 30*a* is an upper end surface of the rolled film product 30*a*.

Figure 6:
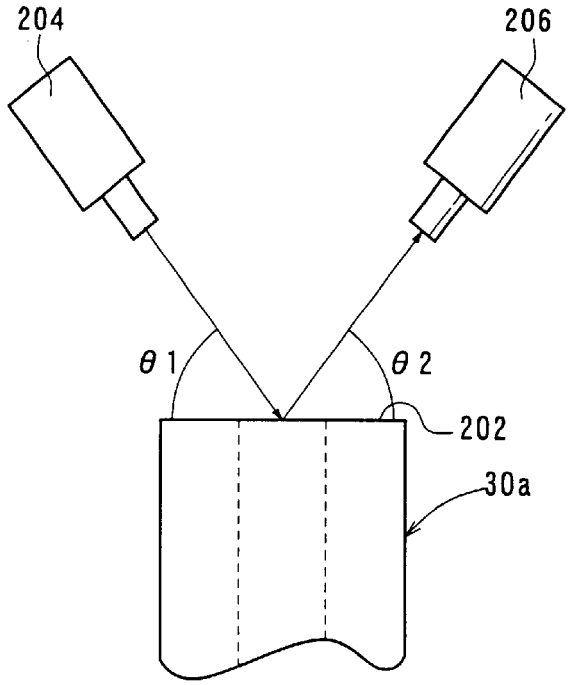
FIG. 6 is a side elevational view of an arrangement of a laser beam source and a photodetector.

As shown in FIG. 6, the laser beam source 204 and the photodetector 206 may be angularly related to each other such that an angle θ1 formed between the optical axis of the laser beam source 204 and the inspected surface 202 ranges from 45° to 60°, and an angle θ2 formed between the central line of the imaging surface of the photodetector 206 and the inspected surface 202 ranges from 45° to 60°. Alternatively, as shown in FIG. 7, the laser beam source 204 and the photodetector 206 may be angularly related to each other such that the angle θ1 formed between the optical axis of the laser beam source 204 and the inspected surface 202 ranges from 45° to 60°, and the angle θ2 formed between the central line of the imaging surface of the photodetector 206 and the inspected surface 202 is approximately 90°.

Figure 7:
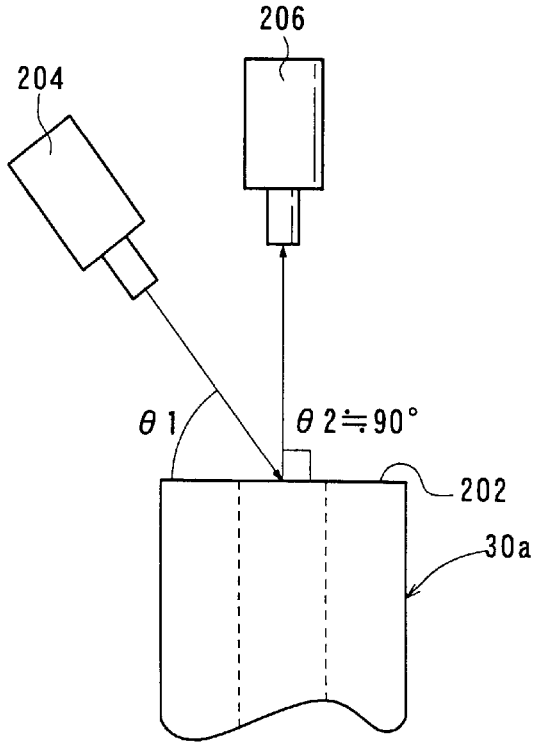
FIG. 7 is a side elevational view of another arrangement of a laser beam source and a photodetector.

The relative angular relationship between the laser beam source 204 and the photodetector 206 it not limited to the examples shown in FIGS. 6 and 7, but may be determined on the basis of the resolution of the image in the image processor 208 and the contrast of the image displayed on the display monitor 210.

Operation of the film rewinder 12 thus constructed will be described below in connection with the film winding apparatus 10 according to the first embodiment.

As shown in FIG. 1, the film roll 14 mounted in the film delivery apparatus 18 is unwound upon rotation of the delivery shaft 32, and an elongate film 16 unreeled from the film roll 14 is guided to the main feed roller 36 of the feed apparatus 20. The main feed roller 36 comprises a suction drum, for example, and is controlled according to a predetermined speed pattern by an AC servomotor (not shown).

The elongate film 16 whose speed has been adjusted by the main feed roller 36 is sent to the edge cutting apparatus 26 in which the opposite edges 22 of the elongate film 16 are cut off by the upper and lower rotary cutters 40, thus producing an elongate film 24 having a predetermined width. The edge cutting apparatus 26 feeds the elongate film 24 to the film winding apparatus 10. The edges 22 severed from the elongate film 16 are wound by the edge winding units 42 according to a predetermined tension pattern.

Figure 8:
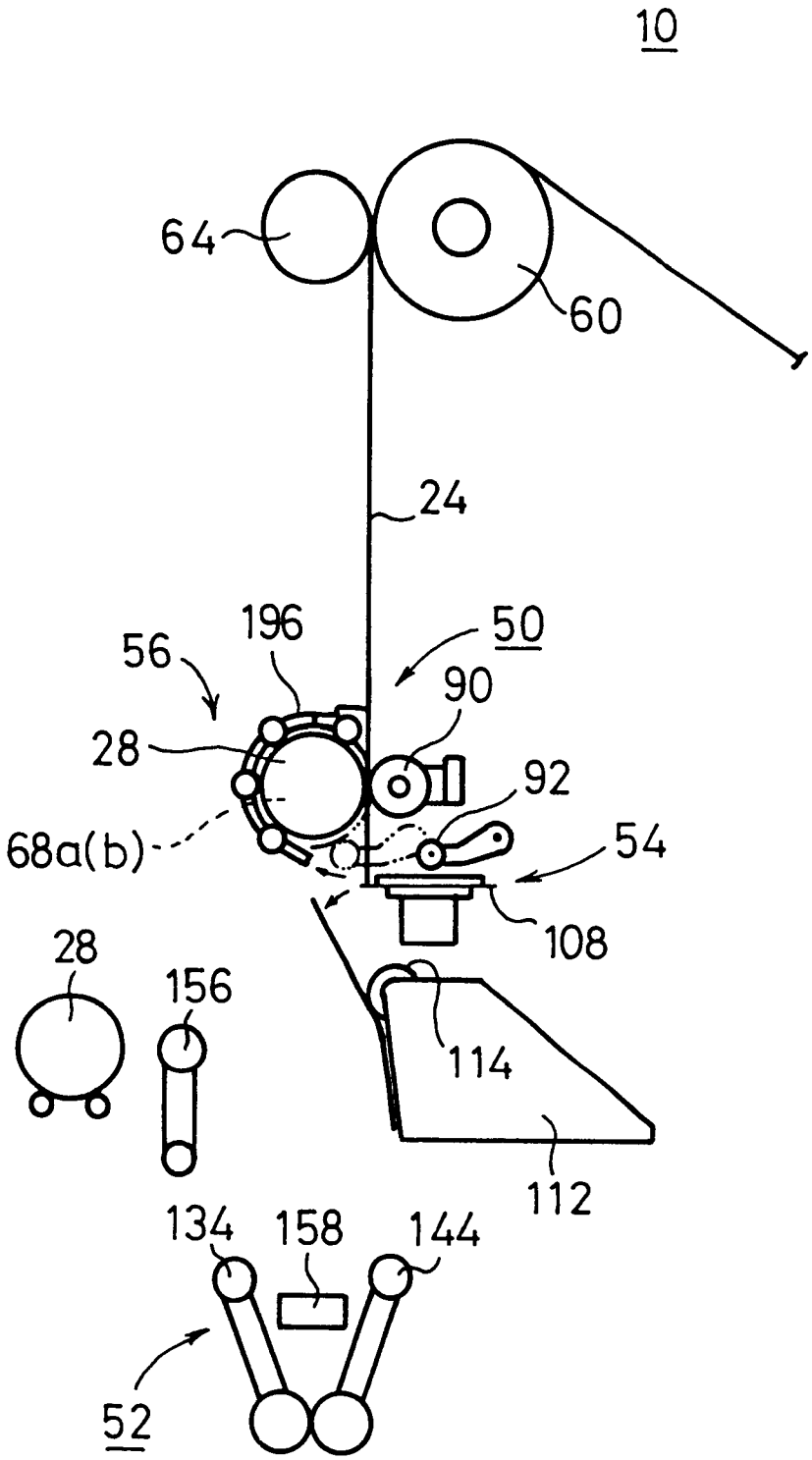
FIG. 8 is a schematic side elevational view showing the manner in which an elongate film is fed to the film winding mechanism.

For the film winding apparatus 10 to start winding the elongate film 24 for a first film roll, as shown in FIG. 8, a roll core 28 is held in a film winding position by the winding chucks 68*a*, 68*b* of the film winding mechanism 50 and the block wrapper 196 of the supply apparatus 56. The elongate film 24 is delivered vertically downwardly by the nip roller 64 and the path roller 60 upon rotation of the path roller 60, and the leading end of the elongate film 24 is automatically or manually brought into a position where it is attracted and held by the suction box 112.

The edges of the elongate film 24 are positionally controlled by guides (not shown) that are positioned in ganged relationship to the winding chucks 68*a*, 68*b*. The elongate film 24 is supported by the path changing roller 114, so that the elongate film 24 extends and is held in a direction perpendicular to the straight line that interconnects the axis of the roll core 28 and the axis of the nip roller 90. Then, the disk cutter 108 of the cutting mechanism 54 moves in a direction across the elongate film 24 to cut off the elongate film 24 transversely.

The second drive cylinder 98 is actuated to displace the guide roller 92 toward the roll core 28. The guide roller 92 now brings the leading end of the severed elongate film 24 into contact with the peripheral surface of the roll core 28 for an angular interval of 90°. The distance between the roll core 28 and the disk cutter 108 is selected such that the distal end of the elongate film 24 can be inserted into the block wrapper 196.

After the guide roller 92 has reached its stroke end, as shown in FIG. 4, the servomotor 72 is energized to cause the belt and pulley mechanism 84 to start rotating the winding chuck 68*a*. The roll core 28 is now rotated to wind the elongate film 24 around the roll core 28 for a length to keep the elongate film 24 under tension, preferably, two or three turns around the roll core 28. Thereafter, the block wrapper 196 is retracted, and the first and second drive cylinders 94, 98 are actuated to move the nip roller 90 and the guide roller 92 away from the roll core 28.

Figure 9:
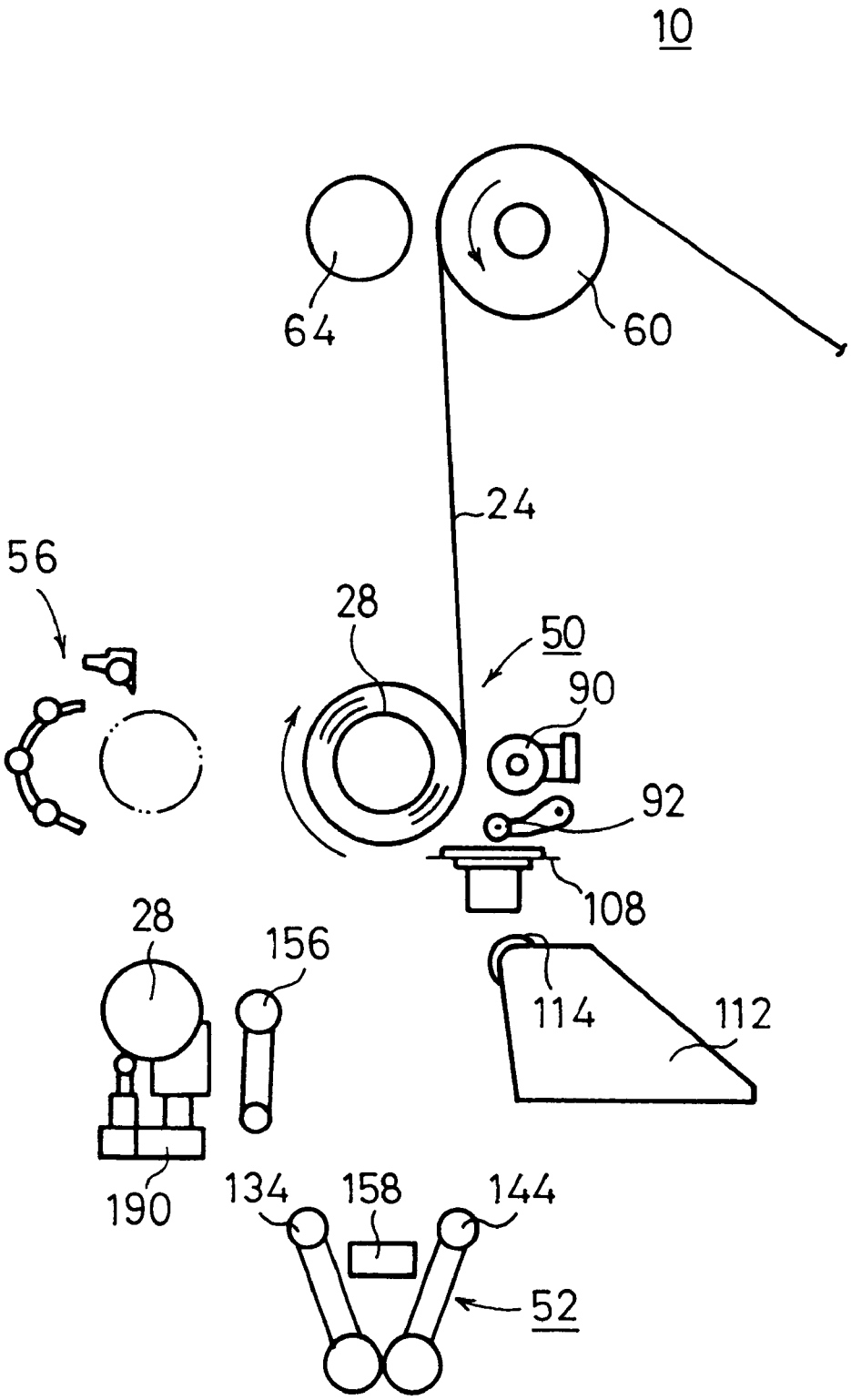
FIG. 9 is a schematic side elevational view showing the manner in which the elongate film is wound around a core.
Figure 10:
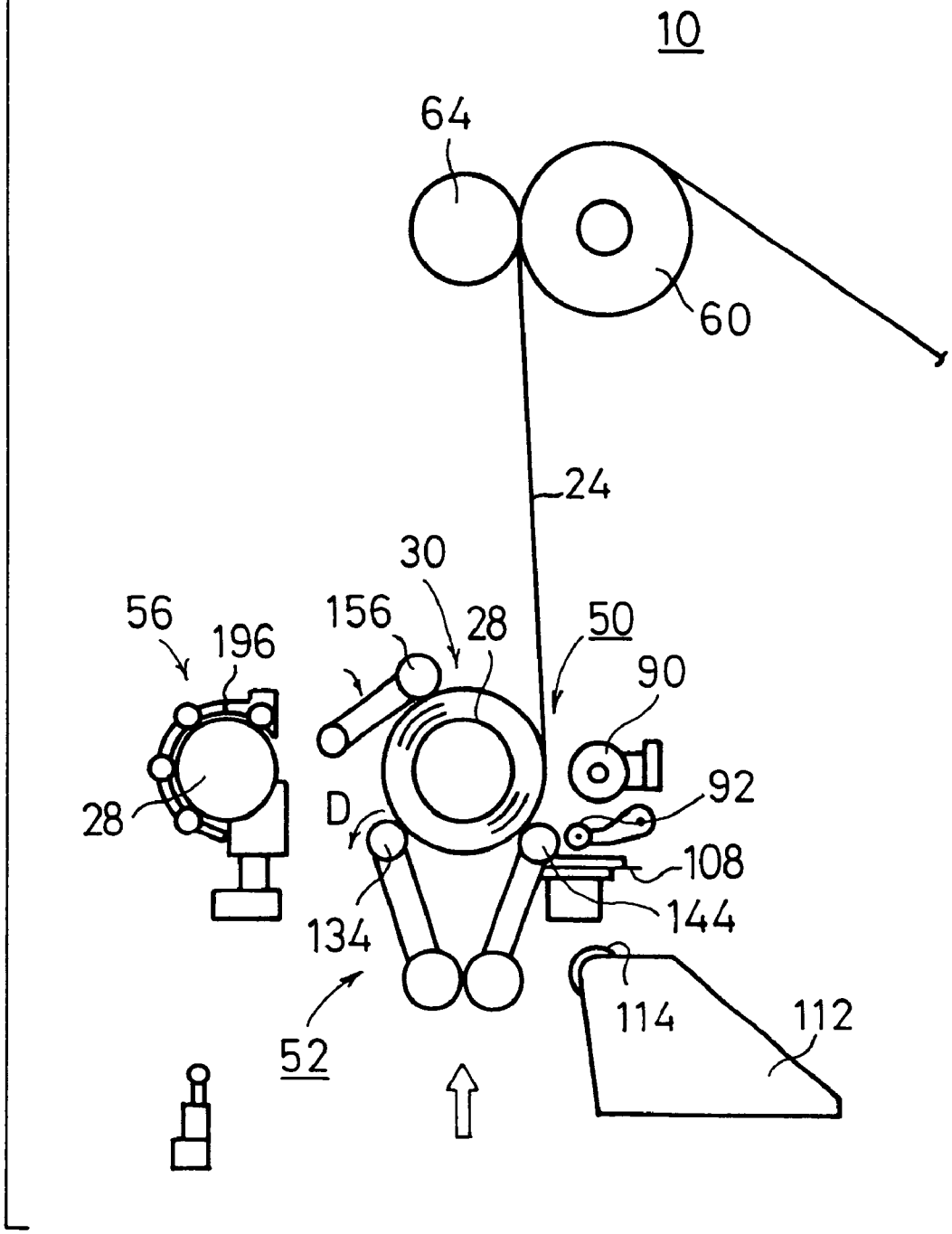
FIG. 10 is a schematic side elevational view showing the manner in which a film roll is received by a product receiving mechanism.

As shown in FIG. 9, when the elongate film 24 has been wound to a predetermined length around the roll core 28 by the film winding mechanism 50, producing a film roll 30, the product receiving mechanism 52 is elevated to cause the rider roller 156, the tensioning roller 134, and the free roller 144 to hold the film roll 30 (see FIG. 10). When the film roll 30 is held by the rider roller 156, the tensioning roller 134, and the free roller 144, the torque of the servomotor 72 has been controlled to impart a certain tension to the elongate film 24 of the film roll 30. The rider roller 156, the tensioning roller 134, and the free roller 144 constitute the product receiving mechanism 52.

The torque motor 126 is then energized to cause the first and second belt and pulley mechanisms 130, 132 to rotate the tensioning roller 134 in the direction indicated by the arrow D in FIG. 10. Therefore, the elongate film 24 is given a predetermined tension by the tensioning roller 134.

The servomotor 72 of the film winding mechanism 50 is de-energized, and the first and second cylinders 78*a*, 78*b* of the slide means 70 are actuated to release the winding chucks 68*a*, 68*b* from the opposite ends of the film roll 30, thereby unchucking the film roll 30. The film roll 30, while being tensioned by the tensioning roller 134 and the free roller 144, is transferred to the product receiving mechanism 52, which is then lowered to a product discharging position.

Figure 11:
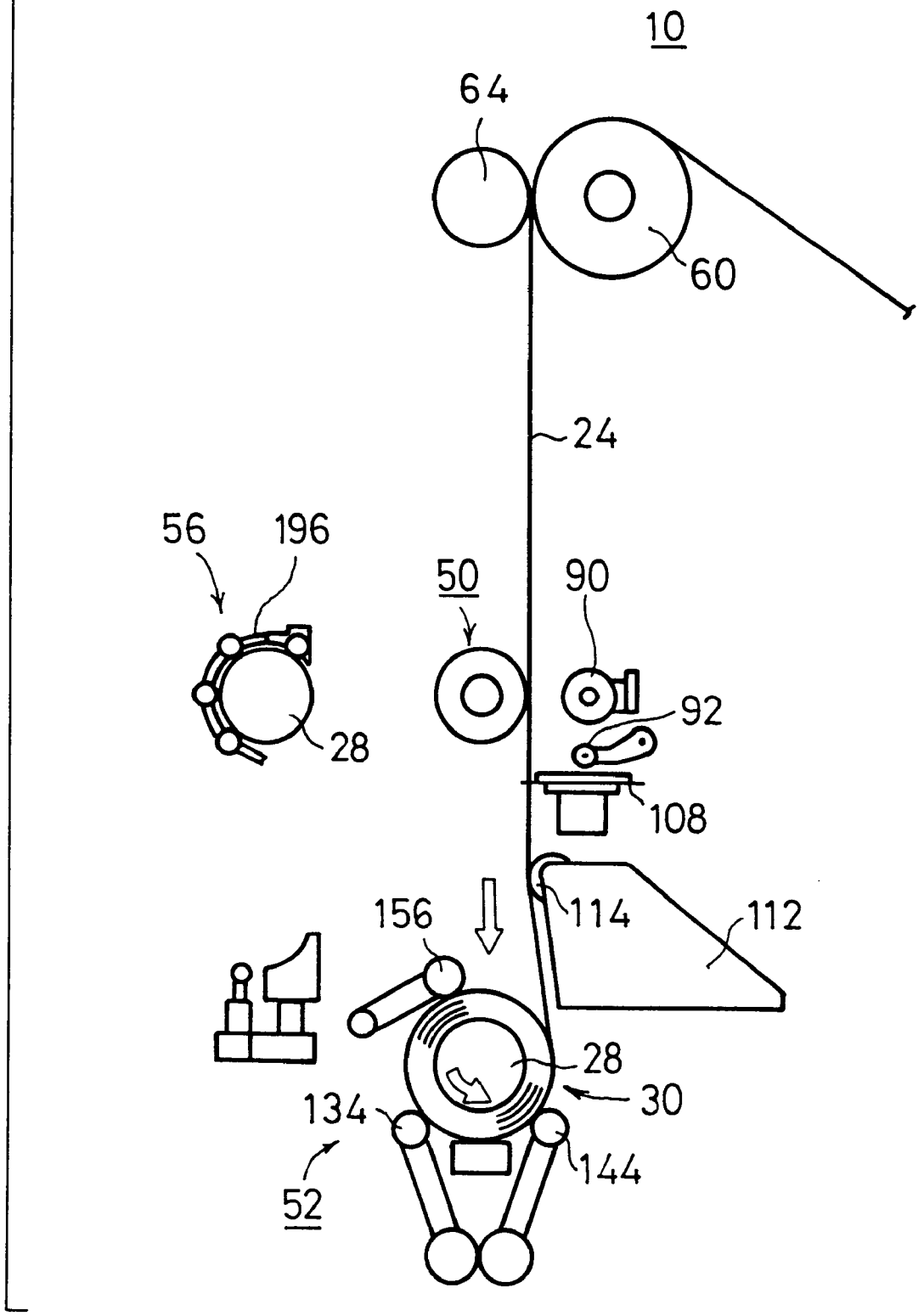
FIG. 11 is a schematic side elevational view showing the manner in which the product receiving mechanism is lowered.

At this time, since an upper portion of the elongate film 24 is immovably held by the path roller 60 and the nip roller 64, as shown in FIG. 11, when the product receiving mechanism 52 is lowered, the film roll 30 rotates in the direction indicated by the arrow and is lowered while unwinding the elongate film 24 from its outer circumference. At this time, the torque motor 126 is rotated in the direction indicated by the arrow D in FIG. 10 at a torque to impart a tension smaller than the tension of the elongate film 24.

When the film roll 30 is lowered, while the outer circumference of the film roll 30 is being held by the rider roller 156, the tensioning roller 134, and the free roller 144, the film roll 30 may be lowered to pull the elongate film 24 from between the path roller 60 and the nip roller 64, i.e., the film roll 30 may be lowered while it is being fixed against rotation. At this time, the torque motor 126 is rotated in the direction indicated by the arrow D in FIG. 10 at a torque to impart a tension greater than the tension of the elongate film 24.

Figure 12:
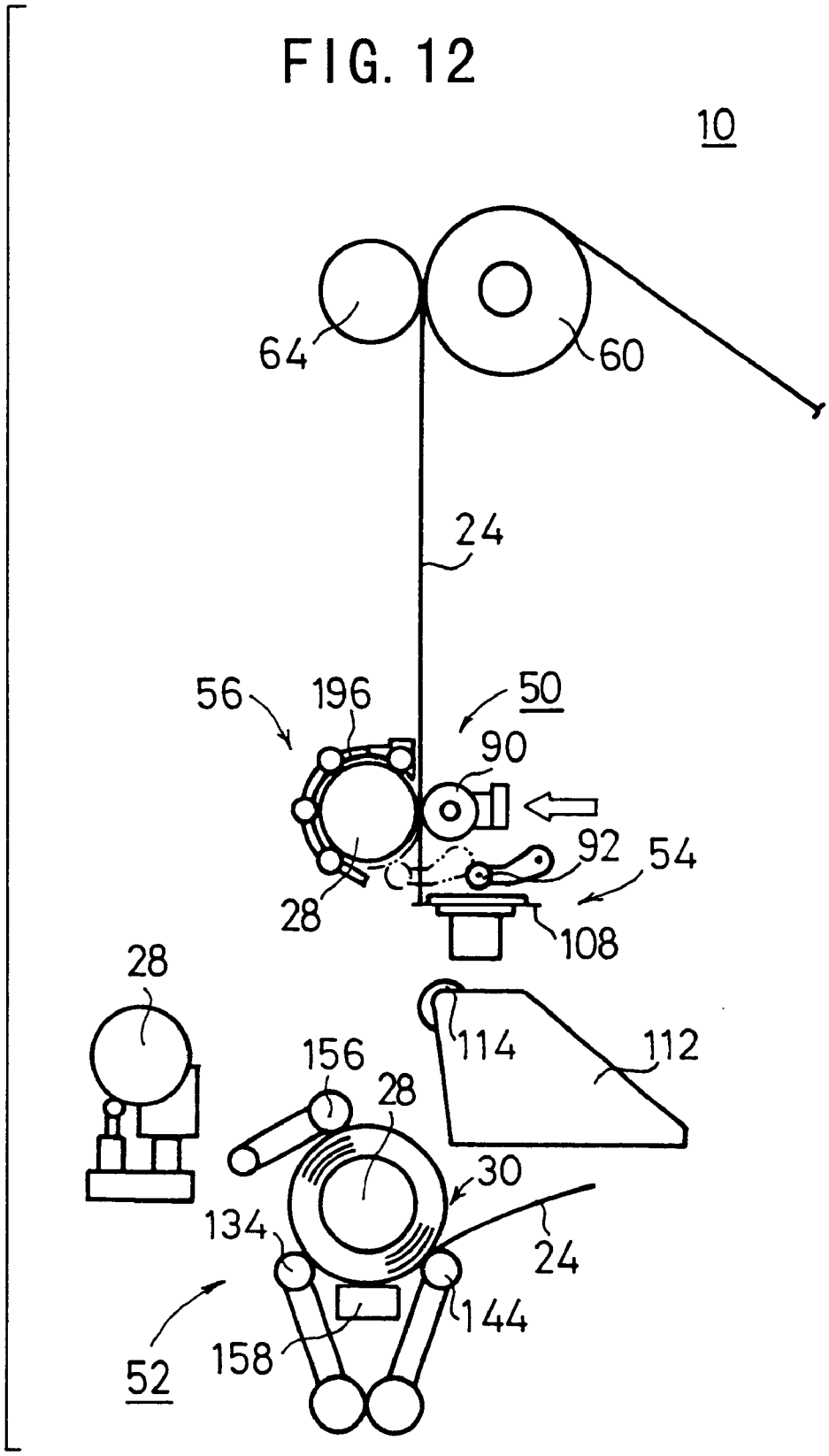
FIG. 12 is a schematic side elevational view showing the manner in which the elongate film is cut off.

As shown in FIGS. 9 and 10, when the elongate film 24 is wound around the roll core 28 by the film winding mechanism 50, a new core 28 is attracted to the suction box 193 on the core support base 190 of the supply apparatus 56, elevated from the core receiving position to the core transferring position,, and then gripped by the block wrapper 196 of the core feeding means 194. After the elongate film 24 has been wound to a predetermined length around the roll core 28, producing a film roll 30, and the film roll 30 has been held and lowered by the product receiving mechanism 52, the block wrapper 196 holds the new core 28 and places the new core 28 in the film winding position, as shown in FIG. 12.

As shown in FIG. 2, the third cylinder 110 is actuated to bring the path changing roller 114 into abutment against the elongate film 24 thereby to hold the elongate film 24 in the vertical direction. At this time, as shown in FIG. 3, the sensor 162 of the detecting means 160 detects whether the elongate film 24 is positionally displaced in the transverse direction indicated by the arrow C or not.

If the sensor 162 detects that elongate film 24 is positionally displaced in the transverse direction, then the film rewinder 12 is deactivated or the automatic correcting means 122 corrects the position of the elongate film 24. Specifically, the servomotor 176 is controlled by a feedback signal based on an output signal from the sensor 162, e.g., a linear length sensor using a laser beam. The ball screw 178 is rotated to move the main assembly 124 in unison with the holder 184 in the direction indicated by the arrow C, so that the film roll 30 held by the product receiving mechanism 52 moves in the direction indicated by the arrow C to correct the transverse position of the elongate film 24.

Then, the torque motor 126 of the product receiving mechanism 52 is energized to tension the elongate film 24, and the first drive cylinder 94 is actuated to project the nip roller 90 to hold the elongate film 24 against the outer circumference of the roll core 28. The disk cutter 108 of the cutting mechanism 54 is actuated to cut the elongate film 28 transversely thereacross. When the guide roller 92 is moved toward the roll core 28 by the second drive cylinder 98, the leading end of the elongate film 24 that is in a free state between the nip roller 90 and the cutter 108 is applied to the circumferential surface of the roll core 28 by the guide roller 92.

If an elongate film 24 which can relatively easily be broken is employed, then it may be cut off by the cutting mechanism 54 after the torque motor 126 has been de-energized, or alternatively, the torque motor 126 may be de-energized while the elongate film 24 is being cut off by the cutting mechanism 54.

Figure 13:
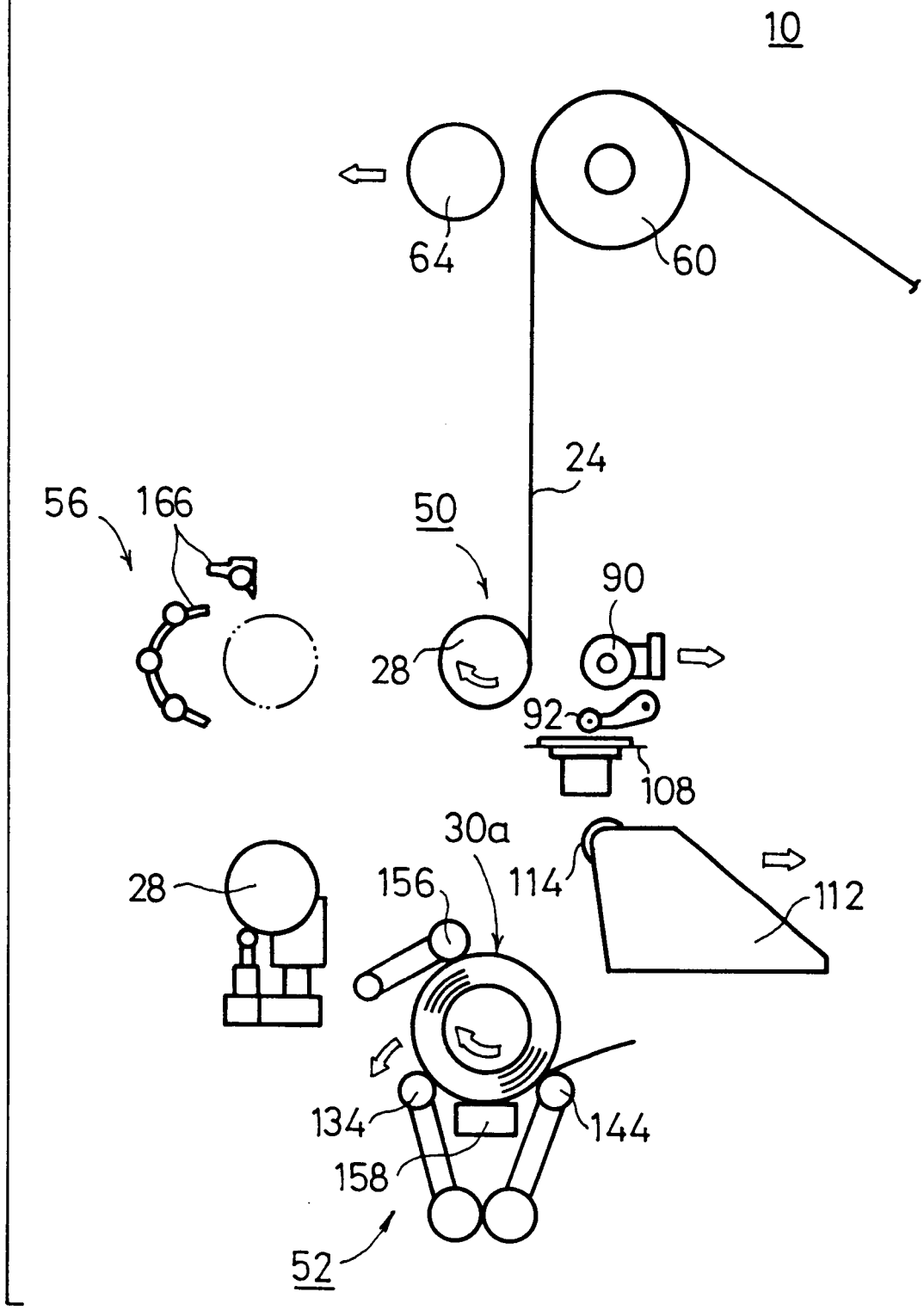
FIG. 13 is a schematic side elevational view showing the manner in which the elongate film starts being wound around the roll core.

After the elongate film 24 has been wound around two or three turns around the roll core 28 by the film winding mechanism 50, the block wrapper 196, the nip roller 90, and the guide roller 92 are retracted, and then the elongate film 24 is wound a predetermined length around the roll core 28 (see FIG. 13).

In the product receiving mechanism 52, the tensioning roller 134 is rotated to rotate a film roll 30*a* in the direction in which the elongate film 24 has been wound, thus winding the trailing end of the severed elongate film 24 to a suitable length. The film roll or rolled film product 30*a* is transferred from the product receiving mechanism 52 to the conveyor 158, which then discharges the rolled film product 30*a*. A tape applying mechanism (not shown) for fastening the trailing end of the elongate film 24 on the rolled film product 30*a* with a tape may be disposed near the product receiving mechanism 52.

In the first embodiment, as described above, after the elongate film 24 has been wound around the roll core 28 by the film winding mechanism 50 to produce the film roll 30, the film roll 30 is transferred to the product receiving mechanism 52, which is lowered to lower the film roll 30, and then the elongate film 24 is transversely cut off by the cutting mechanism 54. During this time, the elongate film 24 is kept under tension.

Consequently, when the film roll 30 is unchucked from the film winding mechanism 50, the elongate film 24 is not released from the tension, and is hence prevented from being displaced from its proper path. As a result, the film roll 30 is prevented from suffering winding defects, such as an edge of the elongate film 24 on the roll core 28 projecting from an end of the roll core 28. Accordingly, it is possible to efficiently produce a high-quality rolled film product 30*a* with a simple process and arrangement.

The product receiving mechanism 52 has the tensioning roller 134 whose torque is controlled by the torque motor 126, and the rider roller 156 for reliably transmitting the drive power from the tensioning roller 134 to the rolled film product 30*a*. Thus, before the film roll 30 is unchucked from the film winding mechanism 50, a predetermined tension can be applied to the film roll 30, and the product receiving mechanism 52 is effectively simplified in its overall construction.

The distance between the tensioning roller 134 and the free roller 144 can be varied by the spring 146 engaging and extending between the first and second swing arms 136, 142. Therefore, the tensioning roller 134 and the free roller 144 can reliably grip film rolls 30 having various different diameters.

In the first embodiment, as shown in FIG. 3, the film rewinder 12 has the detecting means 160 for detecting whether the elongate film 24 is positionally displaced in its transverse directions and the automatic correcting means 122 for positionally correcting the elongate film 24 in the transverse directions. Therefore, even if the elongate film 24 is positionally displaced when the film roll 30 is transferred to the product receiving mechanism 52 or while the elongate film 24 is being wound, the position of the elongate film 24 can automatically detected and corrected when a new core 28 is supplied. Therefore, the elongate film 24 can highly accurately be wound around the roll core 28 at all times.

The principles of an inspecting process carried out by the appearance inspecting apparatus 200 will be described below. It is assumed that the laser beam source 204 and the photodetector 206 are angularly related to each other such that the angle θ1 ranges from 45° to 60° and the angle θ2 is approximately 90°, as shown in FIGS. 7 and 14.

Figure 14:
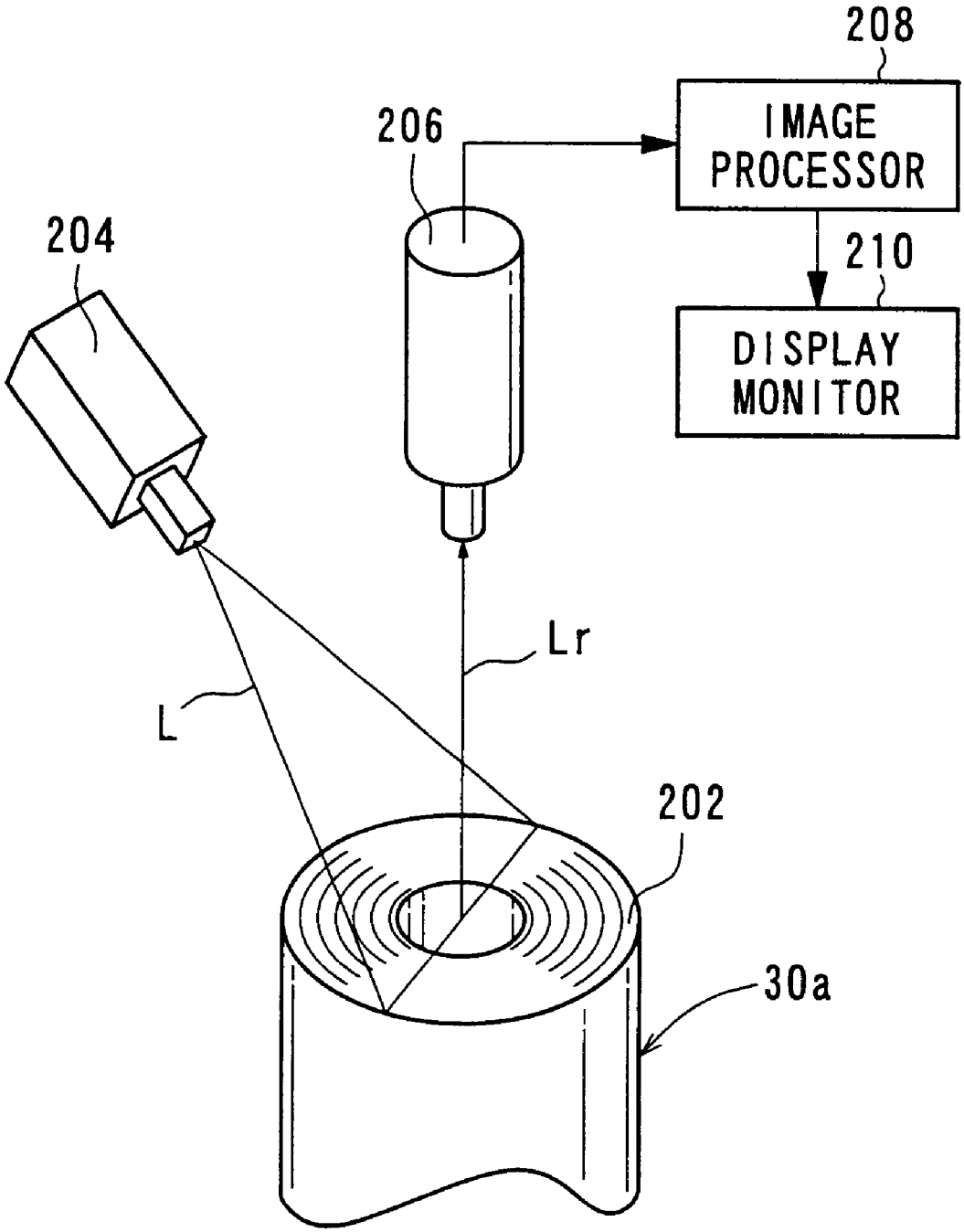
FIG. 14 is a perspective view, partly in block form, of an appearance inspecting apparatus according to another embodiment of the present invention, with a photodetector being arranged in confronting relationship to an inspected surface obliquely.
Figure 15:
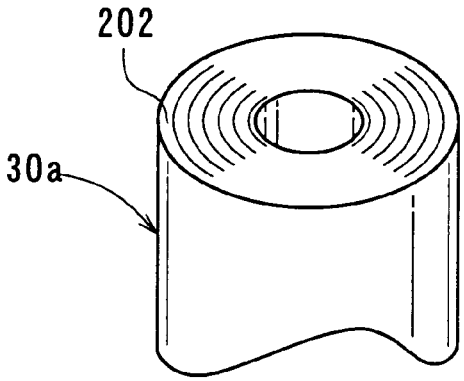
FIG. 15 is a fragmentary perspective view of an inspected product which is rolled well.
Figure 16:
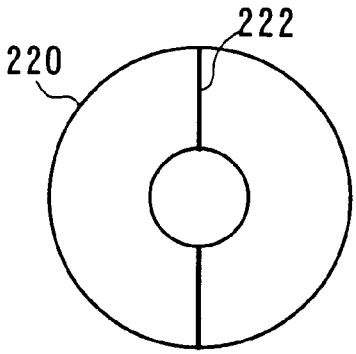
FIG. 16 is a view showing a captured image of the inspected product shown in FIG. 15.

As shown in FIG. 14, the laser beam source 204 applies a linear laser beam L (straight laser beam) in a wavelength range to which the photosensitive material is not sensitive obliquely downwardly to the inspected surface 202 of the rolled film product 30*a*. At this time, a reflected beam Lr from the inspected surface 202 that is irradiated with the linear laser beam L is detected by the photodetector 206. If the rolled film product 30*a* has a good rolled state, as shown in FIG. 15, then a captured image 222 of the reflected beam Lr extends as a straight image in an image 220 of the inspected surface 202, as shown in FIG. 16.

Figure 17:
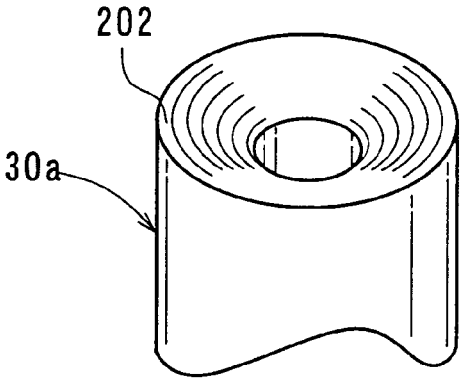
FIG. 17 is a fragmentary perspective view of an inspected product which has a concave conical end face.
Figure 18:
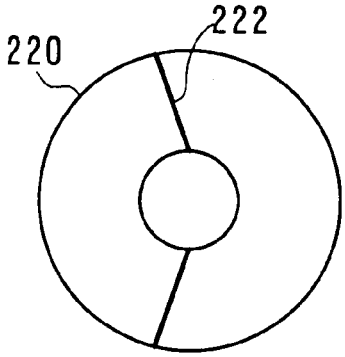
FIG. 18 is a view showing a captured image of the inspected product shown in FIG. 17.

However, if the rolled film product 30*a* has a poorly rolled state, e.g., if the inspected surface 202 has a concave conical shape, as shown in FIG. 17, then a captured image 222 of the reflected beam Lr extends as a line, but is bent at the center of the image 220 of the inspected surface 202, and has a V shape whose arms are tilted toward the laser beam source 204, as shown in FIG. 18.

Figure 19:
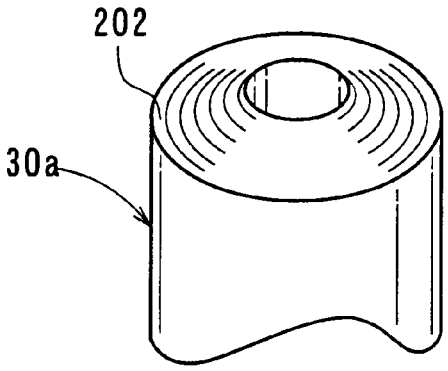
FIG. 19 is a fragmentary perspective view of an inspected product which has a convex conical end face.
Figure 20:
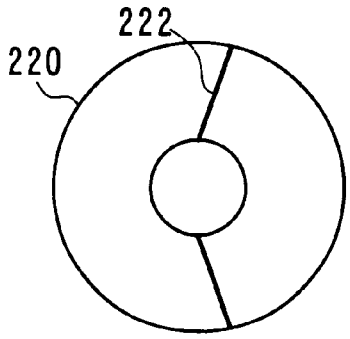
FIG. 20 is a view showing a captured image of the inspected product shown in FIG. 19.

If the inspected surface 202 has a convex conical shape, as shown in FIG. 19, then a captured image 222 of the reflected beam Lr extends as a line, but is bent at the center of the image 220 of the inspected surface 202, and has an inverted V shape whose arms are tilted away from the laser beam source 204, as shown in FIG. 20.

Figure 21:
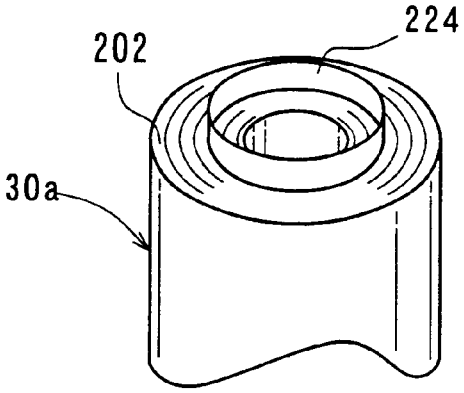
FIG. 21 is a fragmentary perspective view of an inspected product which has a film layer projecting from an end face thereof.
Figure 22:
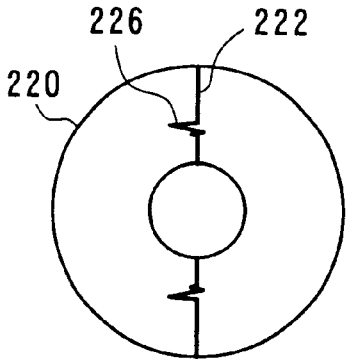
FIG. 22 is a view showing a captured image of the inspected product shown in FIG. 21.

If the rolled film product 30*a* has a film layer 224 projecting from the inspected surface 202, as shown in FIG. 21, then a captured image 222 of the reflected beam Lr extends generally as a line, but includes jagged irregularities 226 corresponding to the projecting film layer 224, as shown in FIG. 22.

Figure 23:
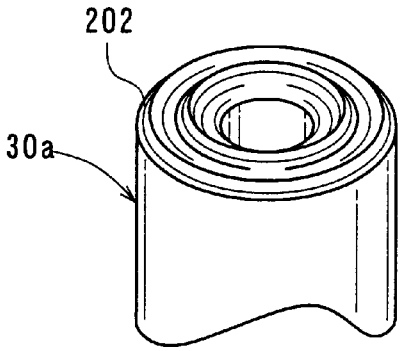
FIG. 23 is a fragmentary perspective view of an inspected product which has an end face displaced wholly or partly.
Figure 24:
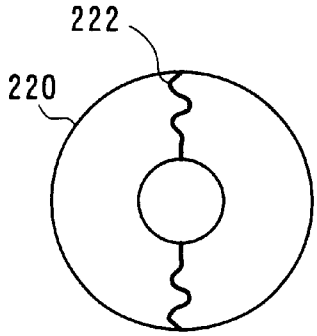
FIG. 24 is a view showing a captured image of the inspected product shown in FIG. 23.

If the rolled film product 30*a* is displaced wholly or partly, as shown in FIG. 23, then a captured image 222 of the reflected beam Lr extends generally as a line, but includes zigzag shapes corresponding to the projecting film layer 224, as shown in FIG. 24.

The image processor 208 judges the inspected surface 202 as "normal" if the image 222 of the reflected beam Lr is a straight image as shown in FIG. 16, and judges the inspected surface 202 as "defective" if the image 222 of the reflected beam Lr is not a straight image as shown in FIGS. 18, 20, 22, and 24.

Figure 25:
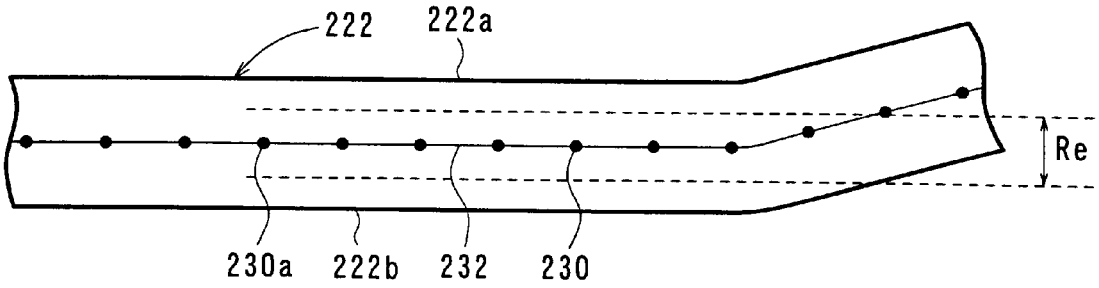
FIG. 25 is a diagram showing principles of determining whether an appearance is good or bad with an image processing device.

For example, as shown in FIG. 25, the image processor 208 determines successive midpoints 230 between a first boundary line 222*a* and a second boundary line 222*b* at the respective opposite ends of the transverse extent of the image 222 of the reflected beam Lr. Then, the image processor 208 judges the inspected surface 202 as "normal" if a line 232 made up of the successive midpoints 230 falls within a predetermined range Re, and judges the inspected surface 202 as "defective" if a portion of the line 232 falls outside of the range Re.

In the appearance inspecting apparatus 200, as described above, the inspected surface 202 of the rolled film product 30*a* which is made of the photosensitive material is irradiated with the linear laser beam L in the wavelength range (upward from 900 nm) to which the photosensitive material is not sensitive. Therefore, the rolled film product 30*a* is protected against unwanted exposure to radiations. Since the reflected beam Lr from the inspected surface 202 is imaged, and the appearance of the rolled film product 30*a* is inspected on the basis of the captured image 222 of the reflected beam Lr. Consequently, the process of inspecting the appearance of rolled film products can be automatized thereby to increase the efficiency with which to manufacture products of the photosensitive material. The process of inspecting the appearance of rolled film products is highly accurate because all the rolled film products can be inspected according to objective evaluating standards.

The inspected surface 202 of the rolled film product 30*a* may not be irradiated with the laser beam L, but may be irradiated with a slit light beam from an LED (Light-Emitting Diode) in the wavelength range (upward from 900 nm) to which the photosensitive material is not sensitive.

In the above embodiment, the end face (inspected surface) 202 of the product 30*a* which comprises a roll of a photosensitive sheet is inspected for its appearance. However, the appearance inspecting apparatus 200 may be used to inspect the appearance of a circumferential surface of the rolled film product 30*a* while the rolled film product 30*a* is rotating, for accurately and quickly detecting a bulge in 20 the circumferential surface, particularly on an edge thereof, due to film layer displacement or the like.

Figure 26:
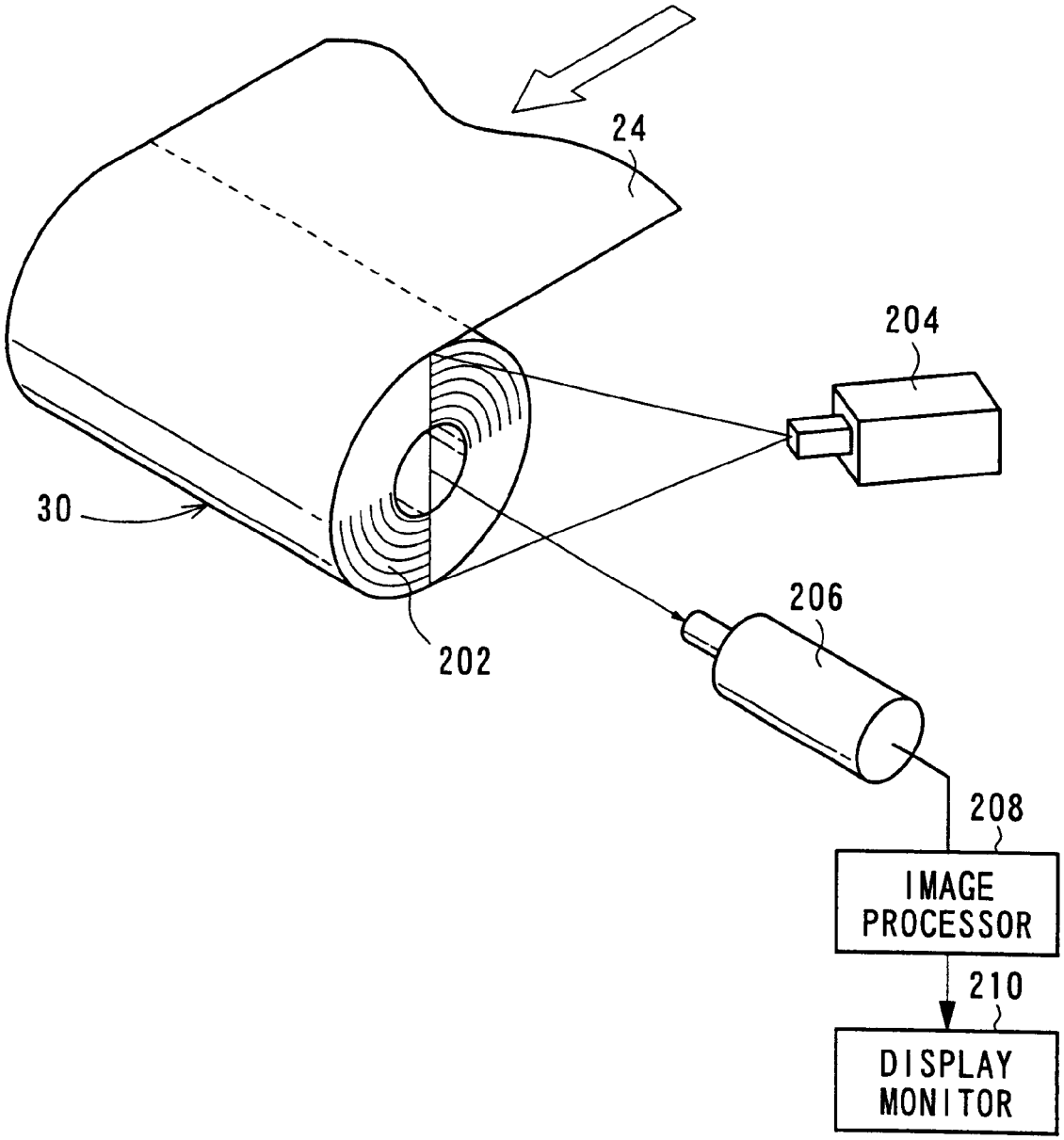
FIG. 26 is a perspective view, partly in block form, of the appearance inspecting apparatus which inspects the appearance of an end face (inspected surface) of a roll of an inspected sheet while it is being wound.
Figure 27:
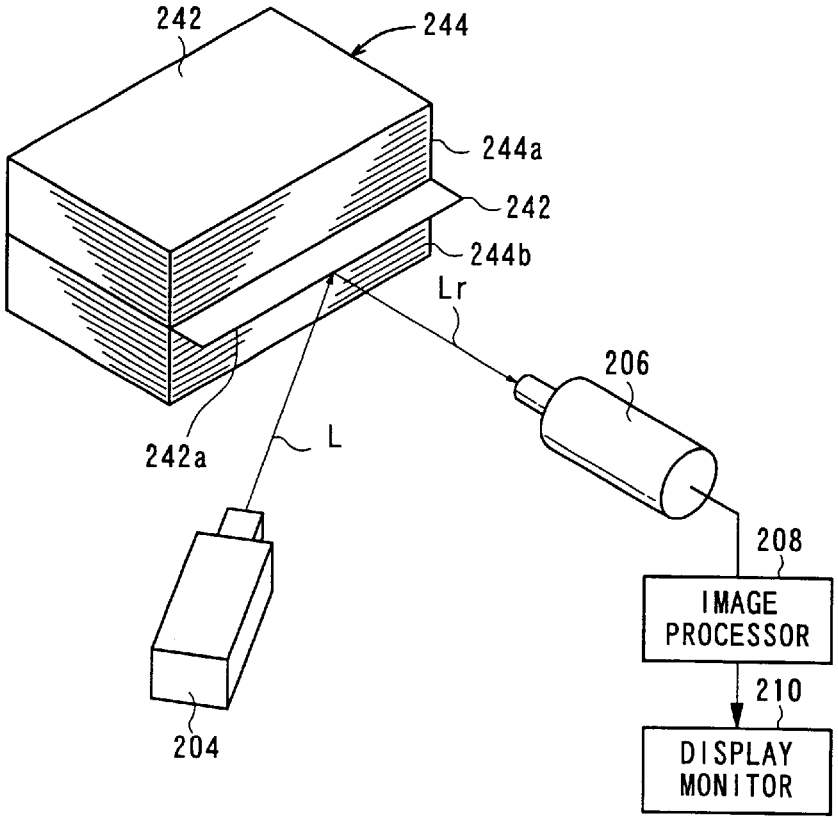
FIG. 27 is a perspective view, partly in block form, of the appearance inspecting apparatus which inspects the appearance of a side surface of a stack of sheets.

As shown in FIG. 26, the appearance of the end face (inspected surface) 202 of the film roll 30 may be inspected while the elongate film 24 of the film roll 30 is being wound. According to this modification, when the appearance of the inspected surface 202 is judged as defective while the elongate film 24 is being wound, the winding of the elongate film 24 is interrupted, and the elongate film 24 can be retrieved or wound again. Therefore, the cost of the material and the loss of time and labor in the operation of the apparatus may be smaller than if the film roll 30 is inspected after the elongate film 24 has been completely wound.

The appearance inspecting apparatus 200 may be applied to the inspection of the appearance of a side surface 244*a* of a stack 244 of photosensitive sheets 242 cut to a rectangular shape. In this application, a laser beam L from the laser beam source 204 is applied obliquely to the side surface 244*a* of the stack 244, and a reflected beam Lr from the side surface 244*a* is detected by the photodetector 206. The appearance of the side surface 244*a* of the stack 244 is inspected on the basis of a captured image of the reflected beam Lr.

Figure 28:
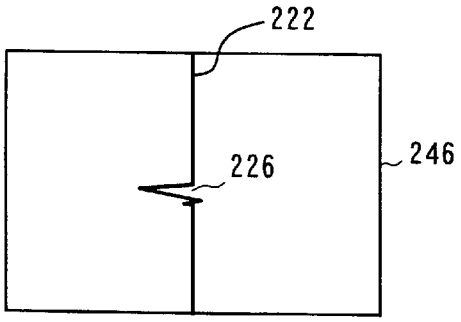
FIG. 28 is a view showing a captured image in inspecting the appearance of a side surface of a stack of sheets.

Specifically, if one of the sheets 242 has an edge projecting from the side surface 244*a,* then a captured image 222 of the reflected beam Lr in an image 246 of the side surface 244*a* extends generally as a line, but includes a jagged irregularity 226 corresponding to the projecting sheet 242, as shown in FIG. 28. The appearance inspecting apparatus 200 is thus capable of inspecting the appearance of the side surface 244*a* accurately and quickly.

The appearance inspecting apparatus 200 may also be used to inspect the appearance of an upper surface of the stack 244 of photosensitive sheets 242. In such an application, the appearance inspecting apparatus 200 is capable of accurately and quickly detecting a bulge in the upper surface, particularly on an edge thereof.

Figure 29:
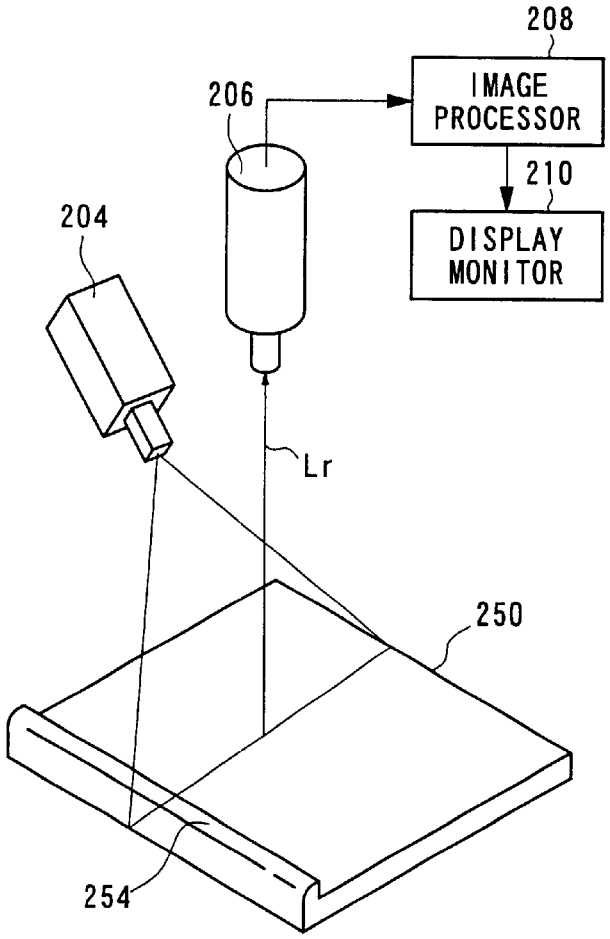
FIG. 29 is a perspective view, partly in block form, of the appearance inspecting apparatus which inspects the appearance of an upper surface of an inspected plate-like member.
Figure 30:
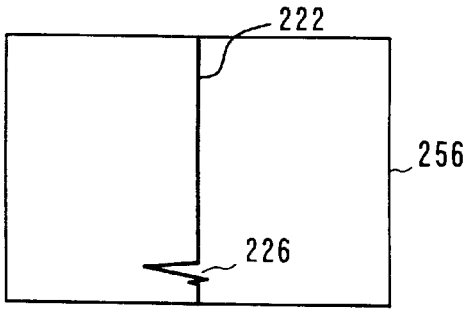
FIG. 30 is a view showing a captured image in inspecting the appearance of an upper surface of an inspected plate-like member.

As shown in FIG. 29, the appearance inspecting apparatus 200 may be applied to the inspection of the appearance of an upper surface 250*a* of a photosensitive plate-like member 250. If the plate-like member 250 has a bulge 254 on an edge thereof, then an image 222 of the reflected beam Lr in an image 256 of the inspected surface 250*a* extends generally as a line, but includes a jagged irregularity 226 corresponding to the bulge 254, as shown in FIG. 30. The appearance inspecting apparatus 200 is thus capable of inspecting the appearance of the plate-like member 250 accurately and quickly.

In the first embodiment, the film winding apparatus 10 is incorporated in the film rewinder 12. However, the film winding apparatus 10 may be incorporated in a cutter. While the supply apparatus 56 employs the block wrapper 196 in the first embodiment, the supply apparatus 56 is also applicable to the automatic winding of an elongate film using the nip roller 90 and a belt wrapper.

Figure 31:
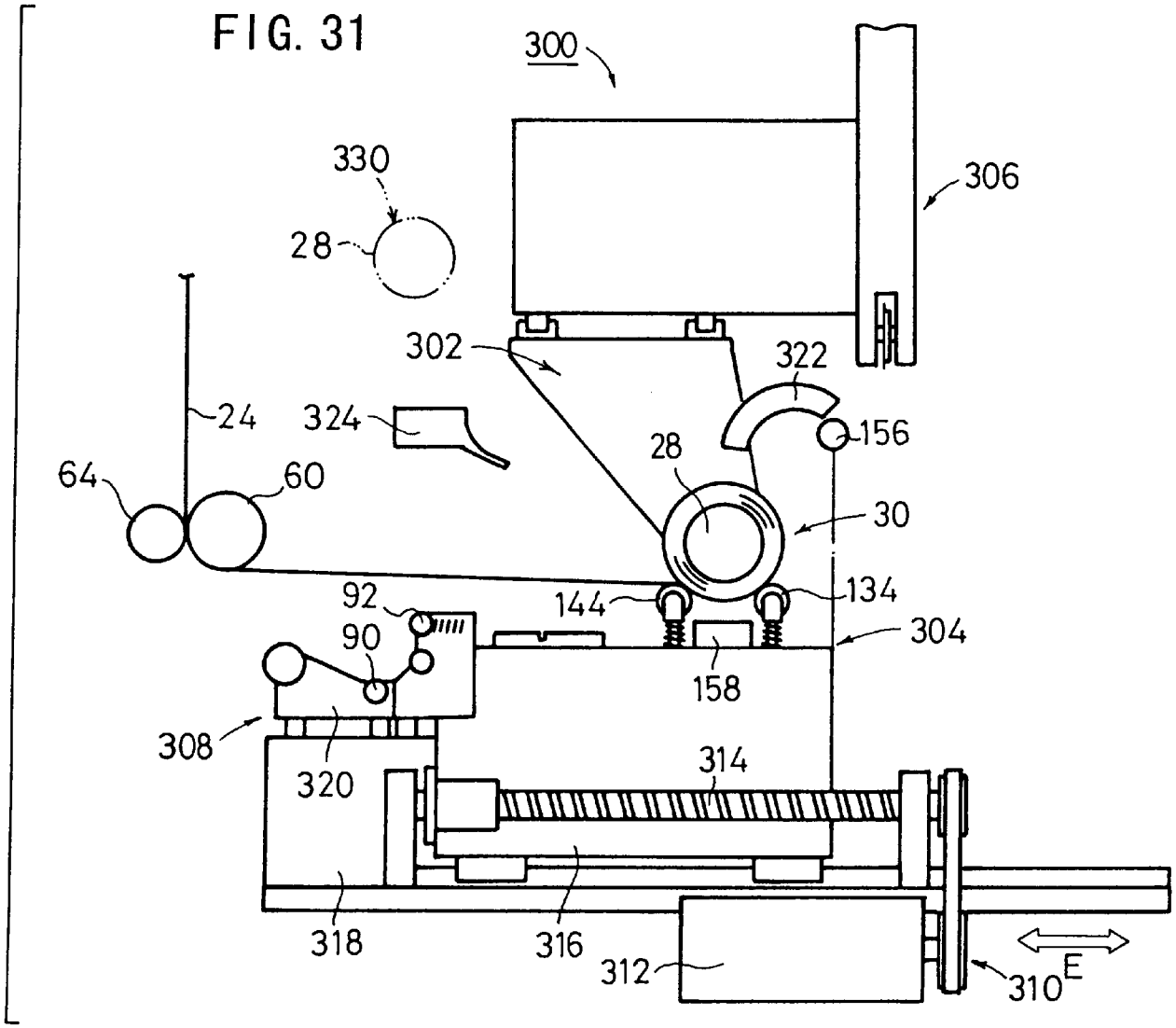
FIG. 31 is a schematic side elevational view of a film winding apparatus according to a second embodiment of the present invention.

FIG. 31 schematically shows a film winding apparatus 300 according to a second embodiment of the present invention. As shown in FIG. 31, the film winding apparatus 300 comprises a film winding mechanism 302, a product receiving mechanism 304, a cutting mechanism 306, and a film winding mechanism 308. Those parts of the film winding apparatus 300 which are identical to those of the film winding apparatus 10 according to the first embodiment are denoted by identical reference numerals, and will not be described in detail below.

The product receiving mechanism 304 has a slide means 310 for horizontally moving a film roll 30 after it has received the film roll 30. The slide means 310 has a motor 312 and a ball screw 314 operatively coupled to the motor 312 and extending horizontally in threaded engagement with a main assembly 316. The film winding mechanism 308 has a movable base 318 that is fixed to the main assembly 316. Therefore, the movable base 318 is movable back and forth in unison with the main assembly 316 in the directions indicated by the arrow E.

A first block wrapper 320 and a guide roller 92 are vertically movably mounted on the movable base 318. A second block wrapper 322 and a movable guide 324 are movably disposed in the vicinity of the film winding mechanism 302.

In the film winding apparatus 300 thus constructed, as shown in FIG. 31, a roll core 28 is rotated by the film winding mechanism 302 to wind an elongate film 24 to a predetermined length therearound, thus producing a fill roll 30. With the elongate film 24 kept under a predetermined tension, the product receiving mechanism 304 is actuated to hold the film roll 30 while the elongate film 24 is being tensioned by the tensioning roller 134.

Figure 32:
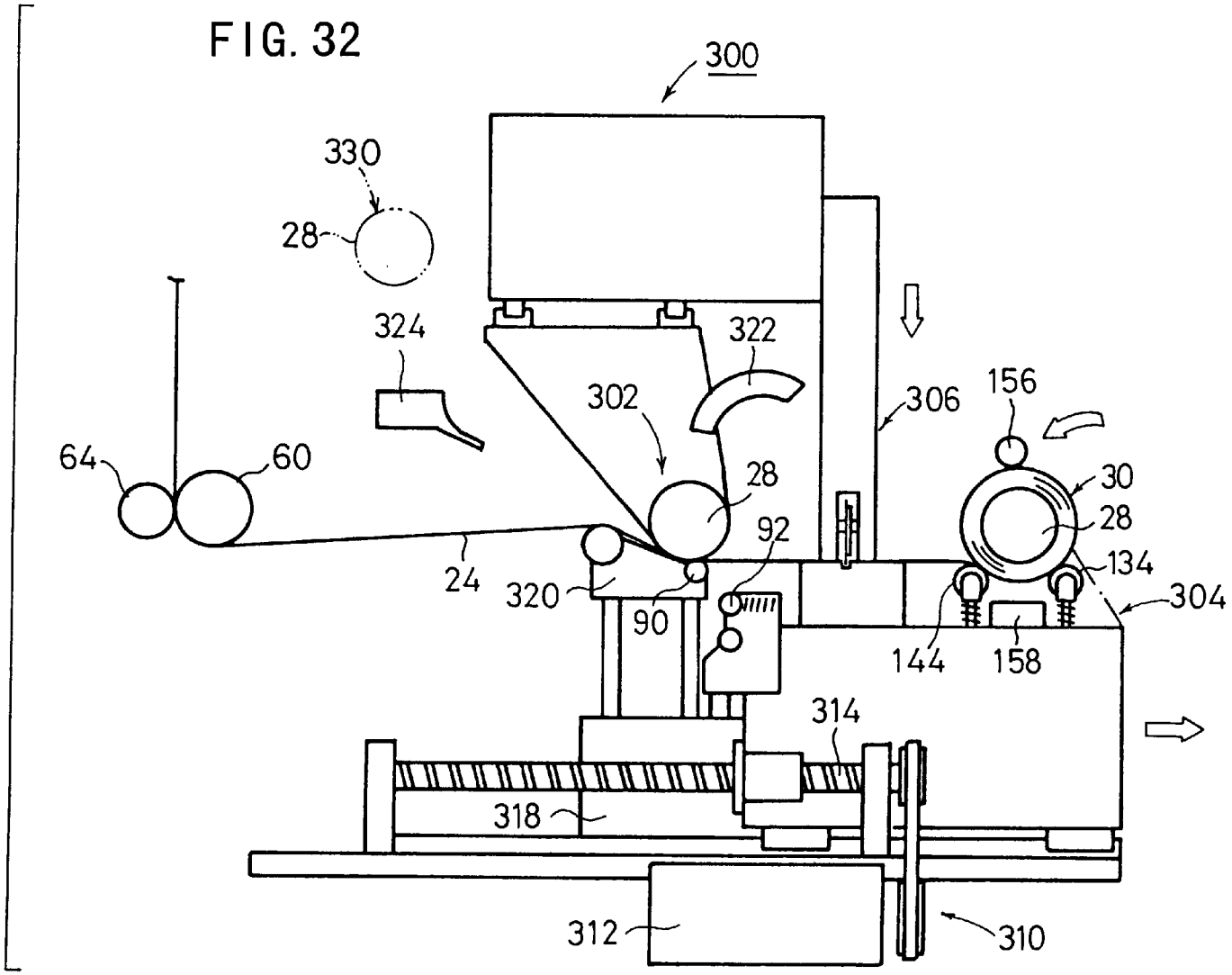
FIG. 32 is a side elevational view showing the manner in which an elongate film is cut off after a film roll has been produced by the film winding apparatus.

After the film winding mechanism 302 has unchucked the film roll 30, the motor 312 of the slide means 310 is energized to move horizontally the film roll 30 that is held by the tensioning roller 134, the free roller 144, and the rider roller 156 (see FIG. 32).

Figure 33:
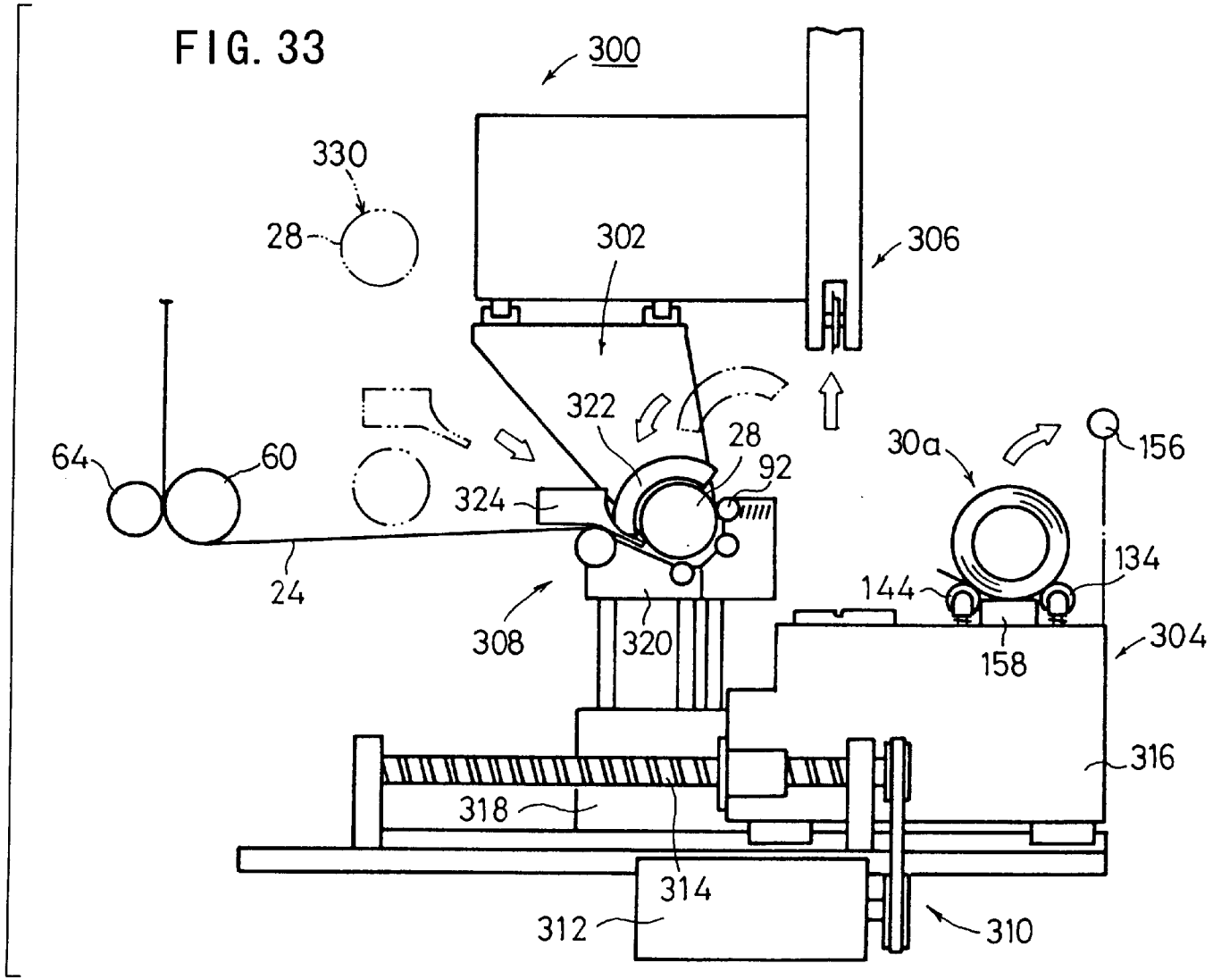
FIG. 33 is a side elevational view showing the manner in which the elongate film, which is cut off in FIG. 32, is wound around a new core.

In the film winding mechanism 302, a new roll core 28 is supplied from a standby position 330 by a supply means (not shown), and the elongate film 24 is held against the outer circumference of the new core 28 by the nip roller 90. The cutting mechanism 306 is actuated to cut the elongate film 24 transversely, after which, as shown FIG. 33, the guide roller 92 is lifted to guide the leading end of the elongate film 24 onto the outer circumference of the roll core 28. The rider roller 156 is released from the rolled film product 30*a*, which is discharged.

When the elongate film 24 starts to be wound around the new core 28, the movable guide 324 and the second block wrapper 322 are positioned over the roll core 28. After the elongate film 24 has been wound a predetermined number of turns around the roll core 28, the movable guide 324 and the second block wrapper 322 are retracted from the roll core 28.

In the second embodiment, therefore, a certain tension is applied to the elongate film 24 at all times after the film roll 30 has been produced by the film winding mechanism 302 and held and moved horizontally by the product receiving mechanism 304 until the elongate film 24 is cut off by the cutting mechanism 306. Consequently, the elongate film 24 is not made tension-free during this process, so that it is possible to efficiently produce a high-quality rolled film product 30*a,* as with the first embodiment.

Figure 34:
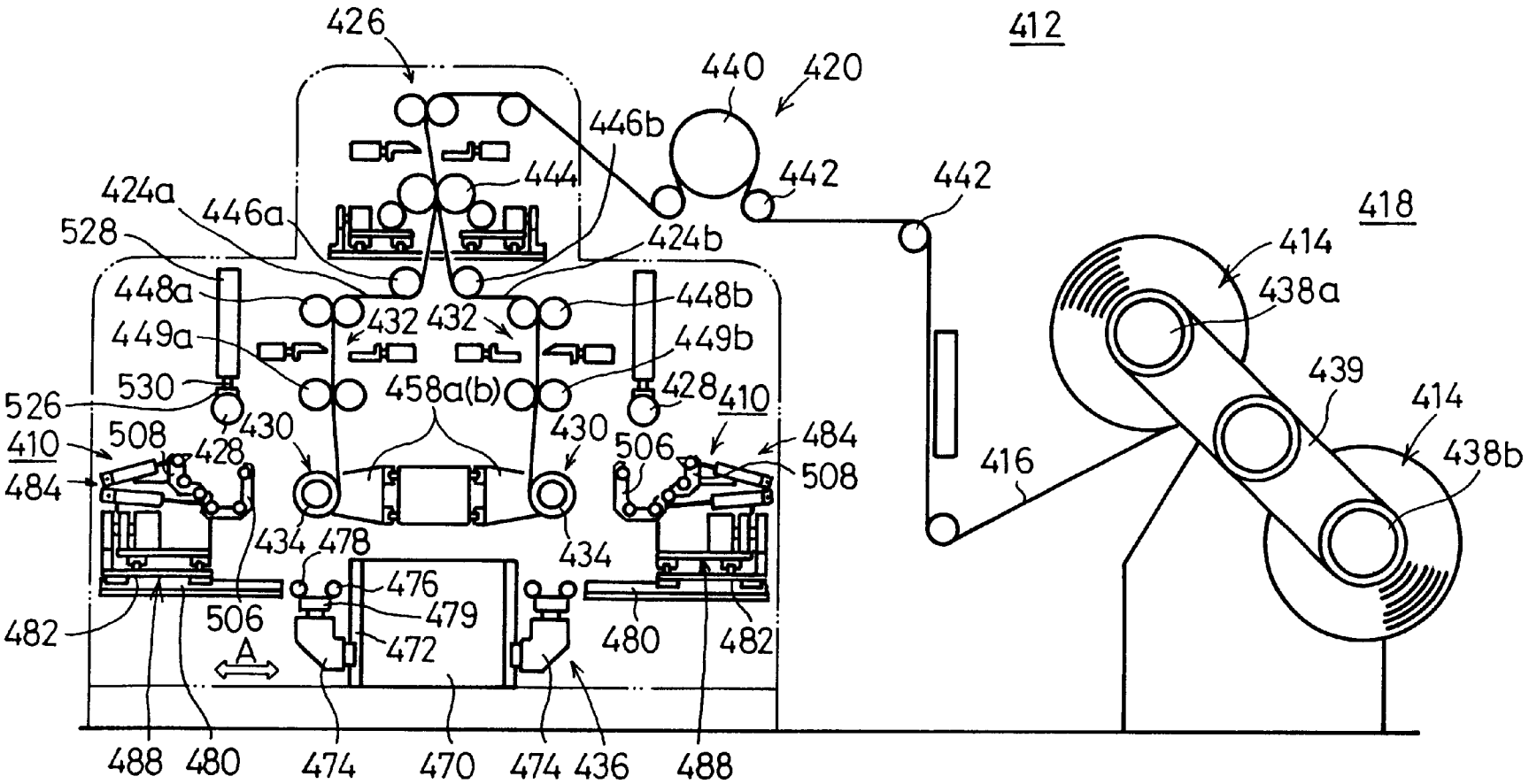
FIG. 34 is a schematic side elevational view of a film cutter which incorporates a film roll core supplying apparatus according to a third embodiment of the present invention.

FIG. 34 schematically shows a film cutter (or film rewinder) 412 which incorporates a film roll core supplying apparatus 410 according to a third embodiment of the present invention.

The film cutter 412 generally comprises a film delivery apparatus 418 for rotating a rolled photosensitive material (hereinafter referred to as "film roll 414") comprising a PET film, a TAC film, or a PEN film as a base, to unwind and deliver an elongate film 416, a feed apparatus 420 for feeding the elongate film 416 successively through subsequent processing stages, a cutting apparatus 426 for transversely cutting the elongate film 416 fed by the feed apparatus 420 to produce elongate films 424*a*, 424*b* each having a predetermined width, a pair of winding apparatus (film winding mechanisms) 430 for winding the elongate films 424*a,* 424*b* around cores 428, a pair of supply apparatus 410 for automatically supplying cores 428 to the winding apparatus 430, a pair of cutting mechanisms 432 for cutting off the elongate films 424*a,* 424*b* to a predetermined length, and a product discharging apparatus 436 for automatically discharging film rolls 434 which comprise the elongate films 424*a,* 424*b* wound around the respective cores 428.

The film delivery apparatus 418 has a pair of delivery shafts 438*a,* 438*b* on which respective film rolls 414 are supported and which are mounted on a turret 439. The feed apparatus 420 has a main feed roller 440 such as a suction drum and a plurality of roller 442. The cutting apparatus 426 has a pair of laterally spaced rotary cutters 444.

Two separation rollers 446*a,* 446*b* for separating the severed elongate films 424*a,* 424*b* away from each other in different directions are disposed below the cutting apparatus 426. The cutting mechanisms 432 are disposed downstream of the separation rollers 446*a,* 446*b* with nip rollers 448*a,* 448*b* interposed therebetween. The winding apparatus 430 are disposed below the cutting mechanisms 432 with nip rollers 449*a,* 449*b* interposed therebetween.

Figure 35:
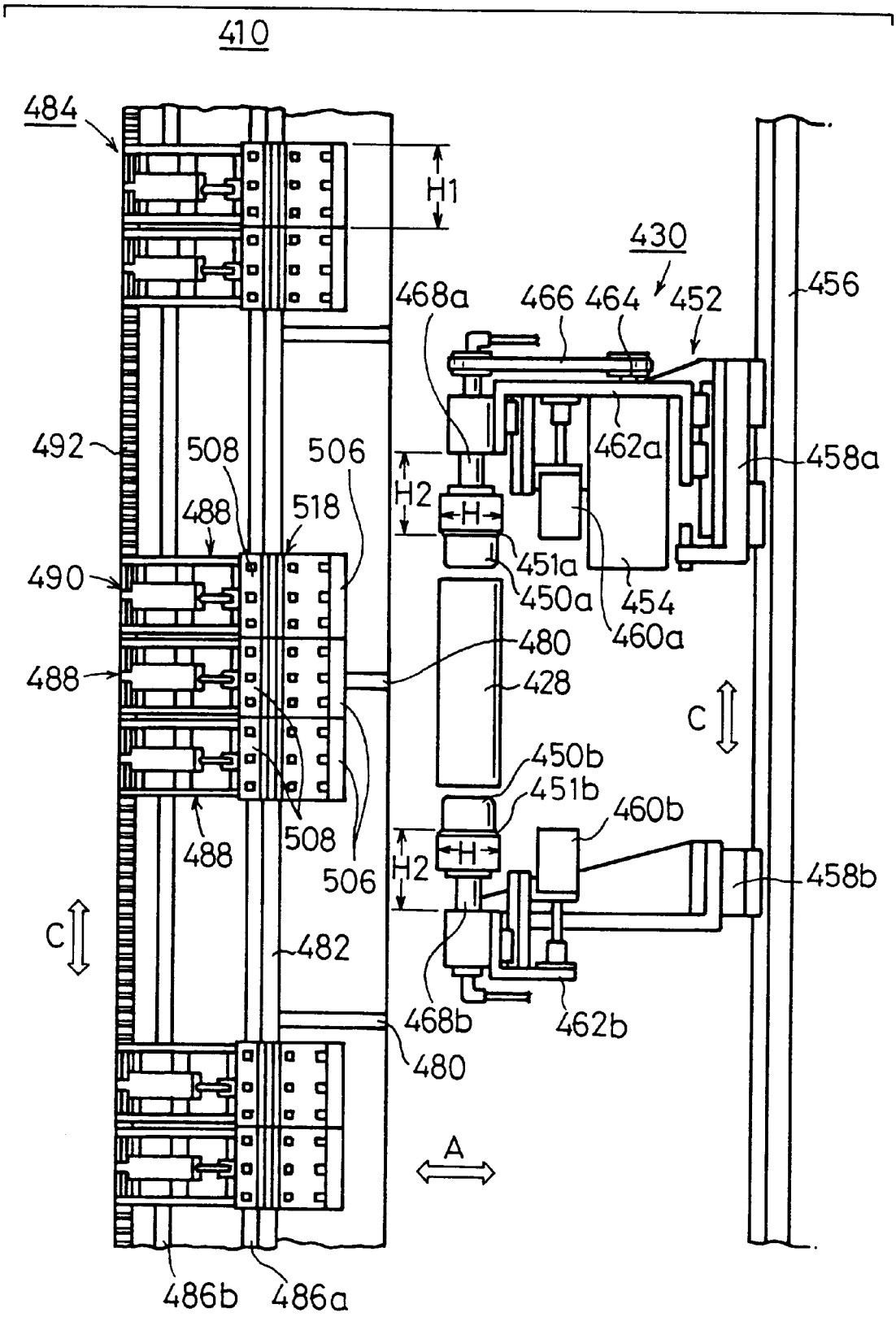
FIG. 35 is a plan view of a film winding apparatus and the film roll core supplying apparatus of the film cutter.

As shown in FIGS. 34 and 35, each of the winding apparatus 430 has a pair of winding chucks 450*a,* 450*b* for holding the respective opposite ends of the roll core 428 and rotating the roll core 428. The winding chucks 450*a,* 450*b* are movable toward and away from each other in the directions indicated by the arrow C by a slide means 452. The winding chucks 450*a,* 450*b* have respective larger-diameter portions next to respective tapers 451*a,* 451*b,* and the larger-diameter portions have an outside diameter H smaller than the outside diameter of the roll core 428. To the winding chuck 450*a,* there is connected a torque-controllable servomotor 454 for tensioning the elongate films 424*a,* 424*b* after the elongate films 424*a,* 424*b* have been wound around the roll cores 428.

The slide means 452 has a pair of base members 458*a,* 458*b* that is positionally adjustable along a guide rail 456. A first movable base 462*a* that is movable back and forth by a first cylinder 460*a* is mounted on the base member 458*a*. The first movable base 462*a* supports thereon a servomotor 454 having a drive shaft 464 that is operatively coupled to a rotatable shaft 468*a* of the winding chuck 450*a* by a belt and pulley mechanism 466. The rotatable shaft 468*a* is rotatably supported on the first movable base 462*a* by a bearing (not shown). A second movable base 462*b* that is movable back and forth by a second cylinder 460*b* is mounted on the base member 458*b*. The winding chuck 450*b* has a rotatable shaft 468*b* rotatably supported on the second movable base 462*b* by a bearing (not shown).

As shown in FIG. 34, the product discharging apparatus 436 has a pair of lifter tables 474 vertically movable along respective guide rails 472 on respective opposite side surfaces of a base 470. Rollers 476, 478 that are rotatable by a respective rotary actuator (not shown) are rotatably supported on each of the lifter tables 474. A conveyor 479 for delivering a film roll 434 to a next processing stage is disposed between the rollers 476, 478.

The supply apparatus 410 are disposed one on each side of the winding apparatus 430, and have respective slide bases 482 disposed for back-and-forth movement on respective guide rails 480 that extend toward the winding apparatus 430 in the directions indicated by the arrow A. The supply apparatus 410 also have respective chuck mechanisms 484 disposed on the slide bases 482 for positional adjustment in directions perpendicular to the guide rails 480.

Figure 36:
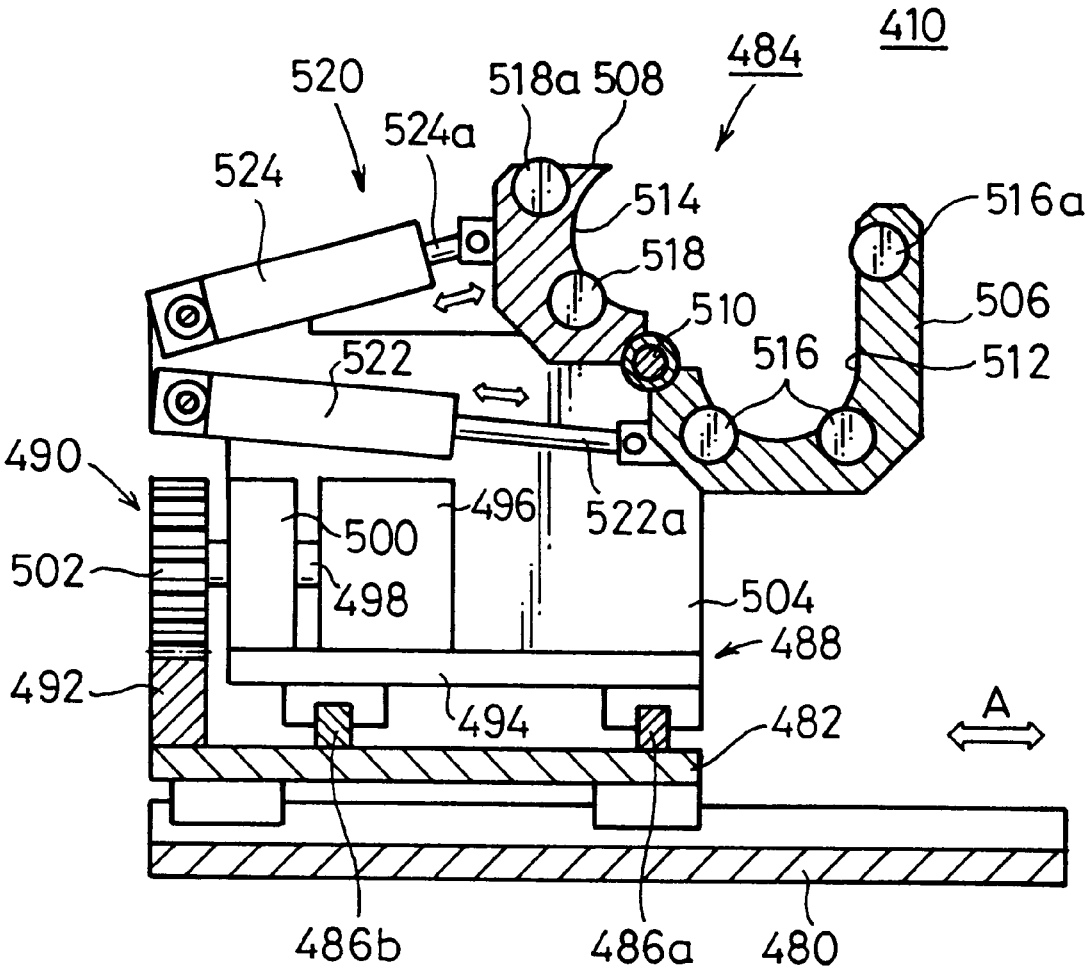
FIG. 36 is a side elevational view of the film roll core supplying apparatus.
Figure 37:
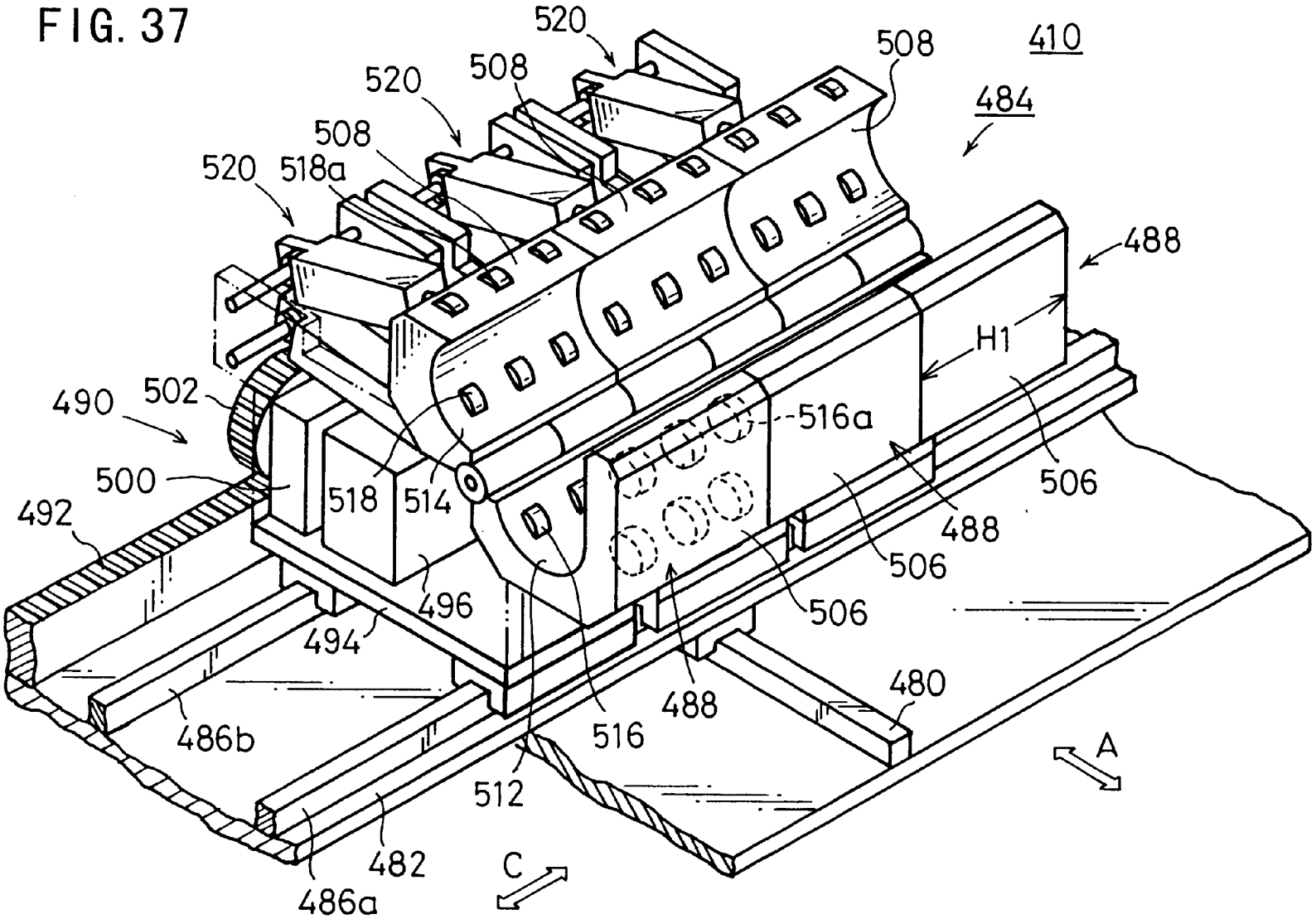
FIG. 37 is a fragmentary perspective view of the film roll core supplying apparatus.

As shown in FIGS. 35 through 37, each of the chuck mechanisms 484 has a plurality of chuck units 488 disposed on rail members 486*a,* 486*b* disposed on the slide base 482 and extending in directions perpendicular to the guide rails 480. Each of the chuck units 488 can be moved in the axial direction of the roll core 28, indicated by the arrow C, by an actuating means 490 which includes a rack 492 fixedly mounted on the slide base 482. The rack 492 extends a predetermined length on the slide base 482, as with the rail members 486*a,* 486*b*.

Each of the chuck units 488 has a movable base 494 movably placed on the rail members 486*a,* 486*b*. The actuating means 490 also includes an AC servomotor 496 with an absolute value encoder which is fixedly mounted on the movable base 494. The AC servomotor 496 has a drive shaft 498 to which there is connected a pinion 502 by an electromagnetic clutch 500 of a holding means. The pinion 502 is held in driving mesh with the rack 492.

A support base 504 is mounted on the movable base 494, and first and second block wrappers (block bodies) 506, 508 are mounted on the support base 504 for angular movement about a pivot shaft 510. The first and second block wrappers 506, 508 have a dimension or width H1 in the axial direction of the roll core 428, and have respective first and second curved surfaces 512, 514, partly of an arcuate shape, that are disposed in confronting relationship to each other and extend in the directions indicated by the arrow C. When the first and second block wrappers 506, 508 are closed, the first and second curved surfaces 512, 514 jointly make up a curved surface whose diameter is slightly greater than the outside diameter of the roll core 428.

On the first and second block wrappers 506, 508, there are mounted a plurality of rotatable rollers (roller members) 516, 516*a*, 518, 518*a* having portions projecting inwardly from the first and second curved surfaces 512, 514. At least surfaces of the rollers 516, 516*a*, 518, 518*a* are made of metal, synthetic resin, or rubber depending on the type of the elongate films 424*a*, 424*b*.

The rollers 516, 516*a* are rotatable only in a predetermined position of the first block wrapper 506 for positioning the axis of the roll core 428. The rollers 518, 518*a* are capable of pressing the roll core 428 under the bias of a spring (not shown), and are movably mounted on the second block wrapper 508. The roller 516*a* on the first block wrapped 506 is coupled to a motor (not shown) for gripping the leading end of the elongate film 424*a*, 424*b* in coaction with the roller 518*a* and smoothly guiding the leading end of the elongate film 424*a*, 424*b* to the roll core 428.

As shown in FIG. 36, an opening and closing means 520 comprises first and second cylinders 522, 524 having respective ends swingably supported on the movable base 494. The first and second cylinders 522, 524 have respective projecting rods 522*a*, 524*a* coupled respectively to the first and second block wrappers 506, 508.

As shown in FIG. 34, a suction cup 526 that is vertically movable by a cylinder 528 is disposed above each of the chuck mechanisms 484 for delivering one roll core 428, at a time, fed by a conveyor (not shown), to the chuck mechanism 484. The cylinder 528 has a vertically movable cylinder rod 530 which supports the suction cup 526 fixedly on its distal lower end.

Operation of the film cutter 412 thus constructed will be described in connection with the film roll core supplying apparatus 410 according to the third embodiment.

As shown in FIG. 34, a film roll 414 loaded in the film delivery apparatus 418 is unwound by the delivery shaft 438*a* as it rotates, delivering an elongate film 416 to the main feed roller 440 of the feed apparatus 420. The main feed roller 440, which comprises a suction drum, for example, is controlled in its speed according to a predetermined speed pattern by the AC servomotor. The elongate film 416 whose speed has been adjusted by the main feed roller 440 is sent to the cutting apparatus 426, and cut by the rotary cutters 444 into elongate films 424*a*, 424*b* each having a predetermined with. The elongate films 424*a*, 424*b* are separated from each other by the separation rollers 446*a*, 446*b*, and then sent vertically downwardly by the nip rollers 448*a*, 448*b*, 449*a*, 449*b*.

Figure 38:
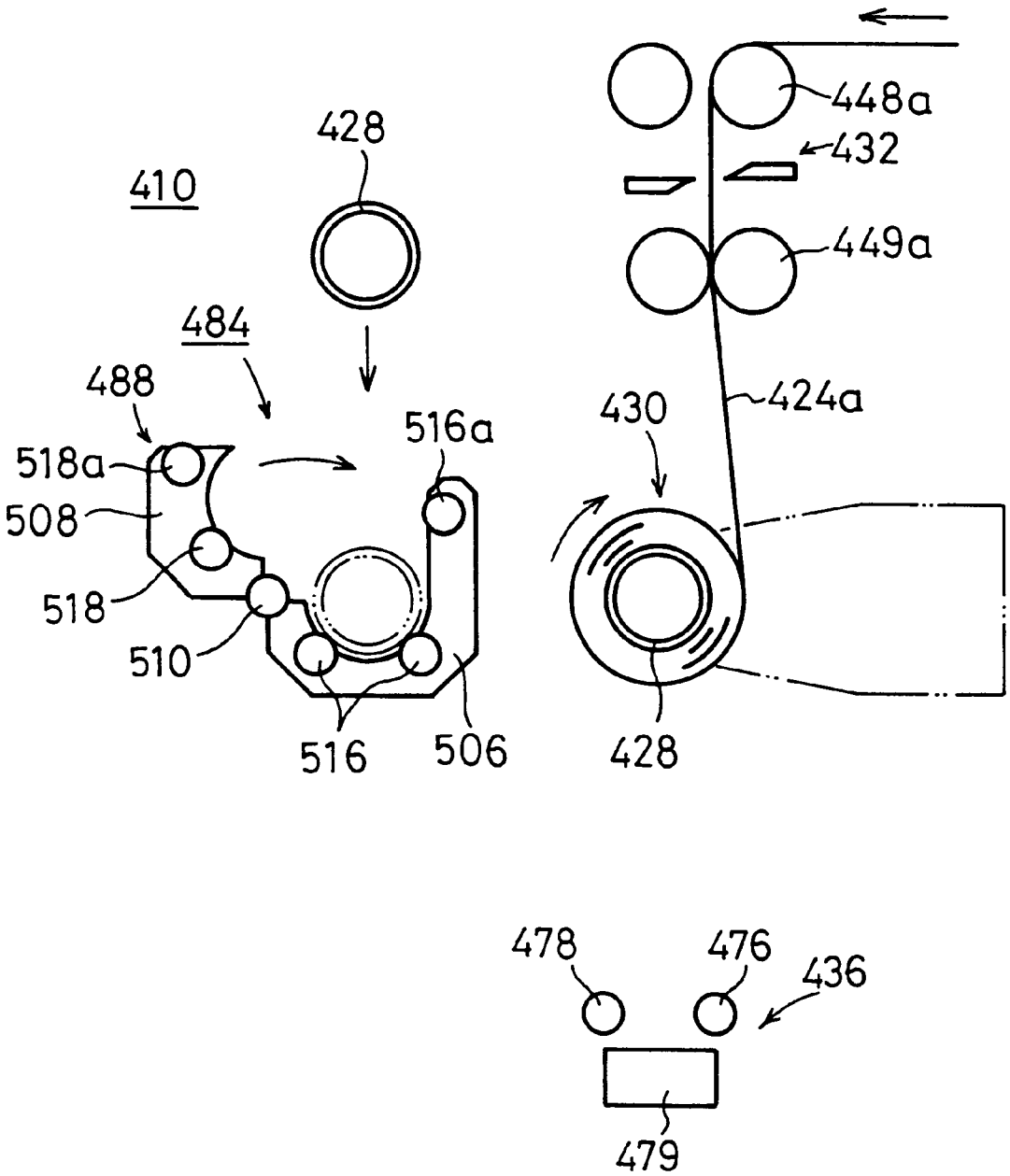
FIG. 38 is a schematic side elevational view showing the manner in which an elongate film is wound around a core.

As shown in FIG. 38, a roll core 428 is held by the winding apparatus 430, and the elongate film 424*a* (the arrangement which handles the elongate film 424*b* in the same manner as the elongate film 424*a* will not be described below) fed to the winding apparatus 430 is wound around the roll core 428. In the supply apparatus 410, the second block wrapper 508 is swung in the opening direction by the second cylinder 524, and a new roll core 428 attracted by the suction cup 526 is disposed above the first block wrapper 506.

The cylinder 528 is actuated to lower the suction cup 526 to deliver the roll core 428 attracted by the suction cup 526 into the first block wrapper 506, as indicated by the two-dot-and-dash lines in FIG. 38. Then, the suction cup 526 releases the roll core 428, and is retracted upwardly, and the second cylinder 524 is actuated to swing the second block wrapper 508 in the closing direction about the pivot shaft 510. The chuck mechanism 484 has its rollers 516, 518 supporting the outer circumference of the roll core 418 while centering the roll core 418 coaxially with the chuck mechanism 484.

Figure 39:
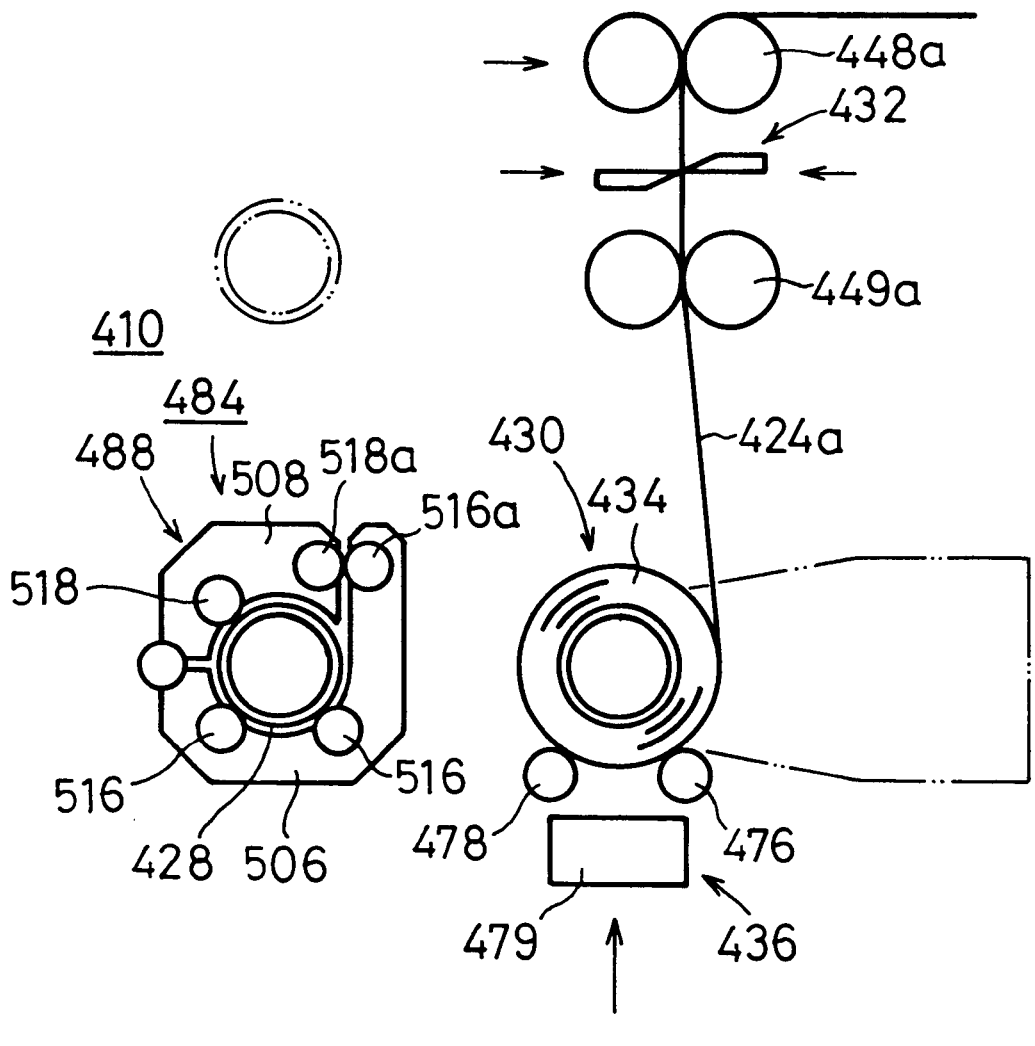
FIG. 39 is a schematic side elevational view showing the manner in which a lifter table is elevated after the elongate film has been wound.

As shown in FIG. 39, substantially at the same time that the roll core 418 is coaxially centered by the chuck mechanism 484, the winding apparatus 430 completes the winding of the elongate film 424*a*. The lifter table 474 of the product discharging apparatus 436 is elevated along the guide rail 472. The film roll 434, which comprises the elongate film 424a wound around the roll core 428, is supported by the rollers 476, 478 on the lifter table 474. The first and second nip rollers 448*a*, 449*a* are closed to hold the elongate film 424*a*, which is then transversely cut off by the cutting mechanism 432.

Figure 40:
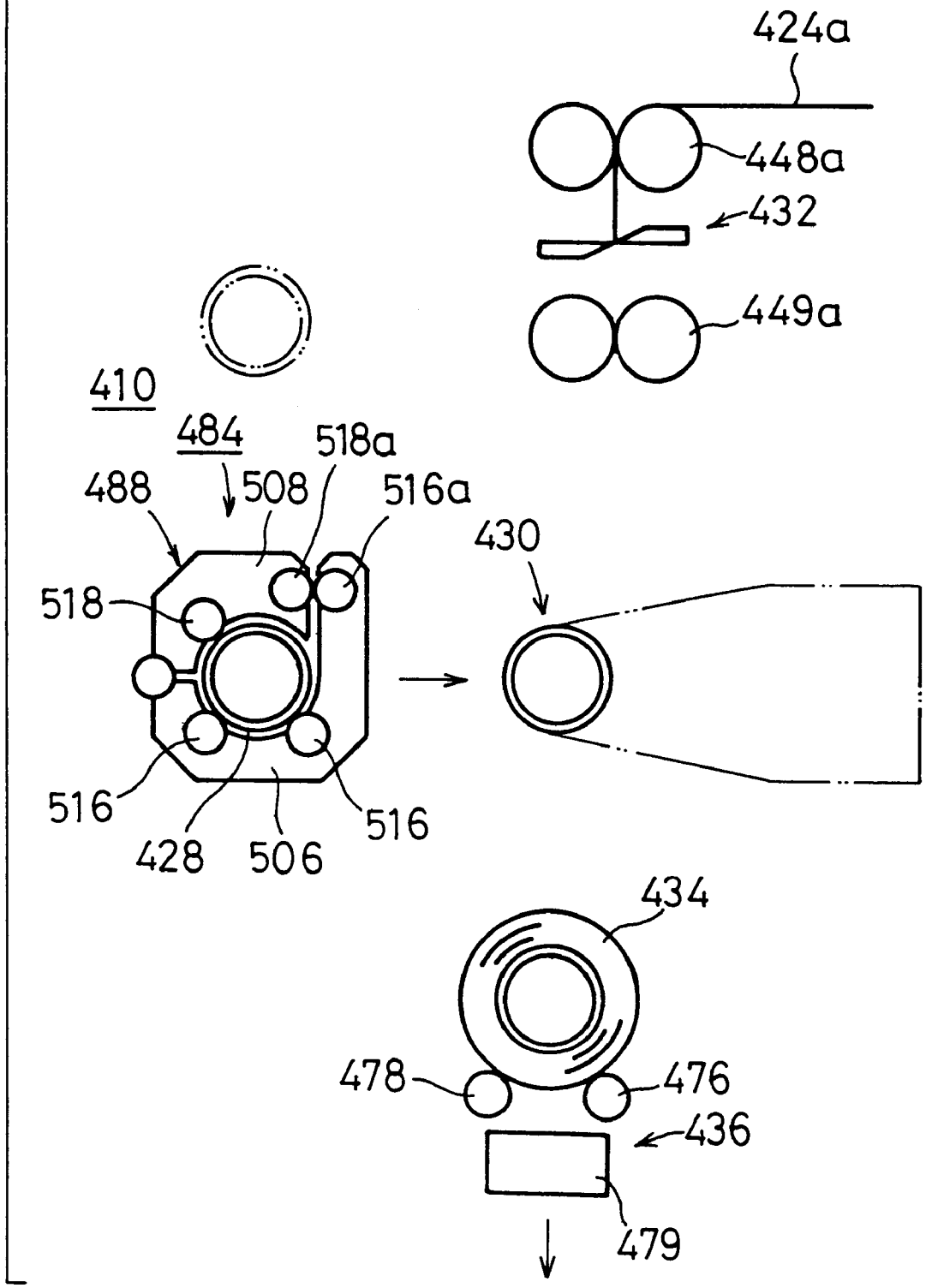
FIG. 40 is a schematic side elevational view showing the manner in which an end of the elongate film is cut off after a film roll has been produced.

As shown in FIG. 40, after the elongate film 424*a* wound around the roll core 428 is cut off, the lifter table 474 supporting the film roll 434 is lowered vertically, and the chuck mechanism 484 with the new roll core 428 coaxially held thereby is moved toward the winding apparatus 430, placing the roll core 428 in the film winding position. In the film winding position, as shown in FIG. 35, the first and second cylinders 460*a*, 460*b* of the winding apparatus 430 are actuated to displace the winding chucks 450*a*, 450*b* toward each other until the winding chucks 450*a*, 450*b* are inserted into the respective opposite ends of the roll core 428 whose circumferential surface is held by the chuck mechanism 484.

The rollers 518 of the second block wrapper 508 are pressed by the tapers 451*a*, 451*b* of the winding chucks 450*a*, 450*b* and retracted into the second block wrapper 508 against the bias of the spring (not shown). Since the larger-diameter portions of the winding chucks 450*a*, 450*b* have the outside diameter H smaller than the outside diameter of the roll core 428, the winding chucks 450*a*, 450*b* can smoothly be inserted between the first block wrapper 506 and the second block wrapper 508.

The electromagnetic clutch 500 of the holding means is deactivated and the chuck unit 488 is movable in the axial direction of the roll core 428. When the winding chucks 450*a*, 450*b* grip the roll core 428, the roll core 428 moves in unison with the chuck unit 488 to absorb an axial displacement thereof.

Figure 41:
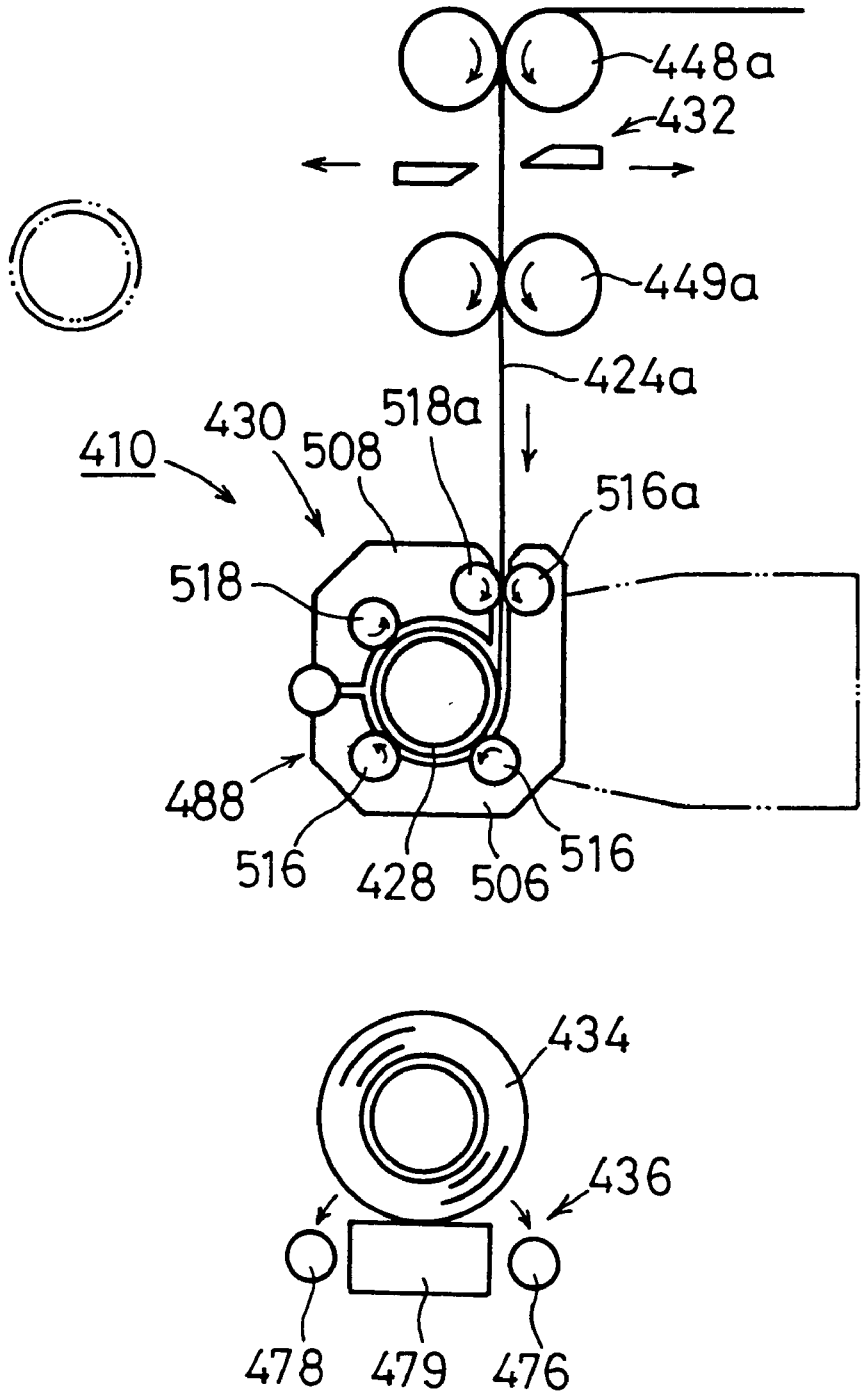
FIG. 41 is a schematic side elevational view showing the manner in which the film roll core supplying apparatus that grips a new core after the elongate film has been cut off is moved to a film winding position.
Figure 42:
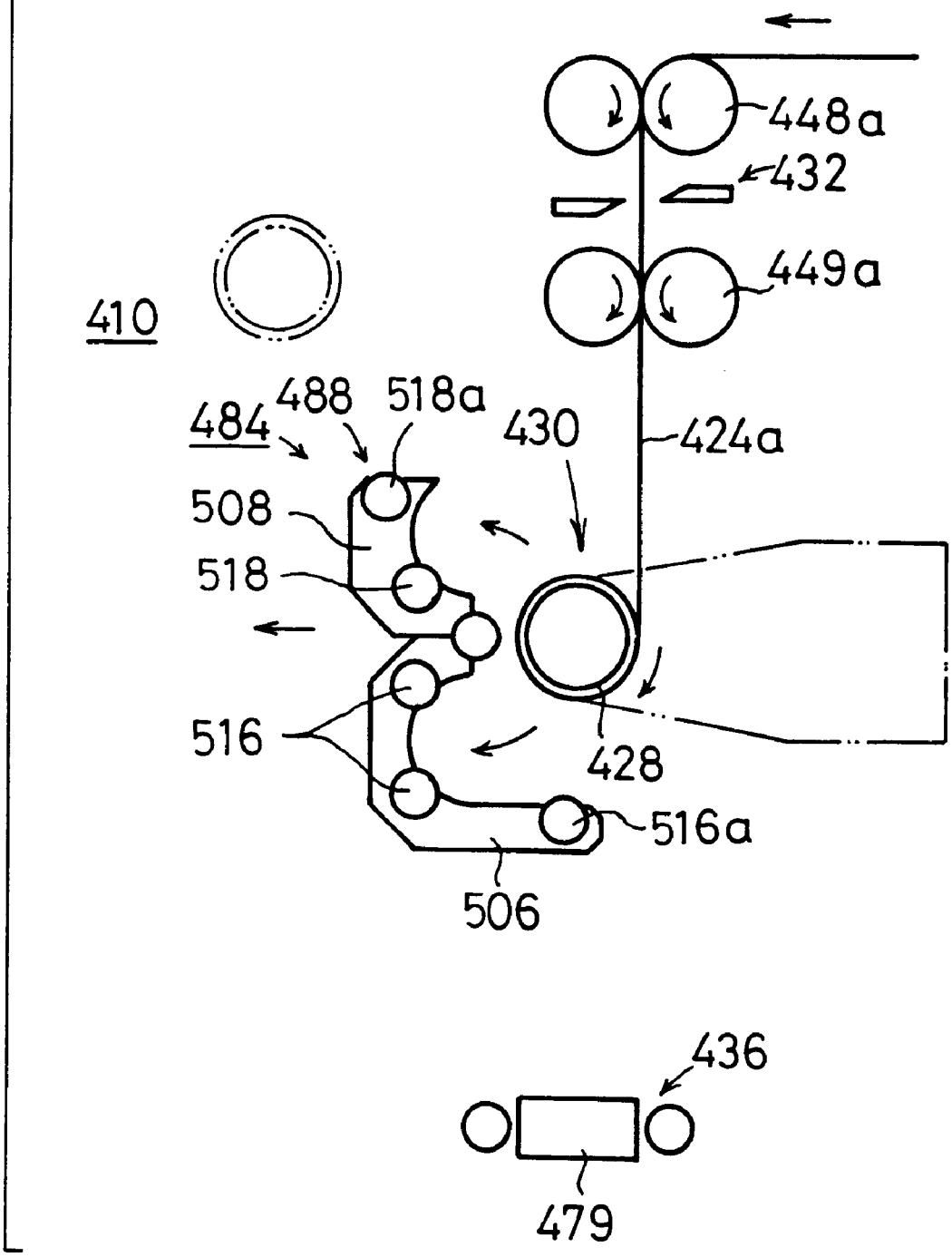
FIG. 42 is a schematic side elevational view showing the manner in which first and second block wrappers of the film roll core supplying apparatus are opened.

The servomotor 454 is energized to cause the belt and pulley mechanism 466 to rotate the winding chuck 450*a* (see FIG. 41). After the elongate film 424*a* is wound two or three turns around the roll core 428, the first and second cylinders 522, 524 are actuated to swing the first and second block wrappers 506, 508 in the opening direction about the pivot shaft 510, and the chuck unit 488 of the chuck mechanism 484 is moved away from the winding apparatus 430 (see FIG. 42).

While the elongate film 424*a* is being wound around the roll core 428, the first and second nip rollers 448*a*, 448*b* are open, and the film roll 434 disposed on the lifter table 474 is discharged to a next processing stage by the conveyor 479.

Figure 43:
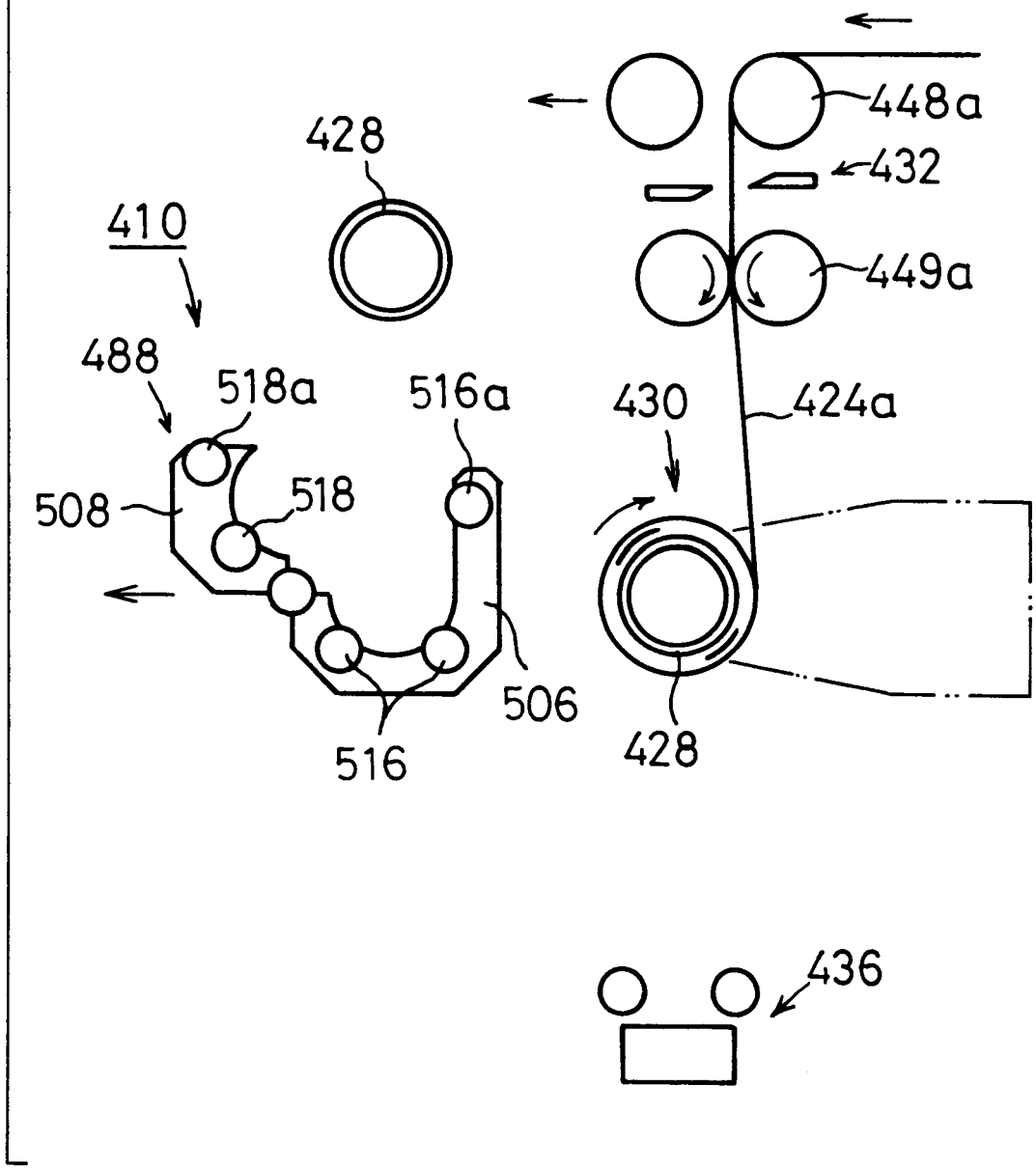
FIG. 43 is a schematic side elevational view showing the manner in which the first and second block wrappers are retracted and the elongate film is wound around the roll core.

After the chuck unit 488 is retracted to a predetermined position, the AC servomotor 496 thereof is energized to cause the pinion 502 and the rack 492 to correct the position of the chuck unit 488. The first cylinder 522 is actuated to bring the first block wrapper 506 into a position for receiving a new roll core 428 (see FIG. 43).

In the third embodiment, as described above, the first and second block wrappers 506, 508 have the dimension or width H1 in the axial direction of the roll core 428 which is indicated by the arrow C, as shown in FIG. 37. When the first and second block wrappers 506, 508 are opened and closed, the entire circumferential surface of the roll core 428 can coaxially be held by the rollers 516, 518.

Then, the chuck unit 488 is moved to bring the roll core 428 held by the first and second block wrappers 506, 508 into the film winding position. Immediately after the opposite ends of the roll core 428 have been held by the winding chucks 450*a*, 450*b* of the winding apparatus 430, the servomotor 454 is energized to rotate the roll core 428 to start winding the elongate film 424*a* therearound.

In the winding apparatus 430, since the core 428 coaxially held by the first and second block wrappers 506, 508 is rotated, the elongate film 424*a* can quickly and efficiently be wound around the roll core 428. Because the overall circumferential surface of the roll core 428 is axially supported by the first and second block wrappers 506, 508, the elongate film 424*a* can reliably be wrapped around the roll core 428 fully over the axial length thereof, without suffering a wrapping failure.

In the third embodiment, the chuck unit 488 is movable along the rail members 486*a*, 486*b* axially of the roll core 428. When the opposite ends of the roll core 428 that is coaxially held by the first and second block wrappers 506, 508 are gripped by the winding chucks 450*a*, 450*b* of the winding apparatus 430, the electromagnetic clutch 500 of the holding means is deactivated.

Even if the roll core 428 is axially displaced, when it is gripped by the winding chucks 450*a*, 450*b*, the chuck unit 488 moves in unison with the roller core 428 in the direction indicated by the arrow C, thus absorbing the axial displacement of the roll core 428. Consequently, it is possible to prevent a winding failure which would otherwise occur when an edge of the elongate film 424a projects outwardly from the end of the roll core 428 due to an axial displacement of the roll core 428.

In the third embodiment, furthermore, the chuck unit 484 has a plurality of chuck units 488 each positionally adjustable in the directions indicated by the arrow C. If the roll core 428 has a different axial length, therefore, a certain number of chuck units 488 corresponding to the axial length of the roll core 428 are juxtaposed in the direction indicated by the arrow C, and the circumferential surface of the roll core 428 can reliably be held fully over its axial length by those chuck units 488.

For example, it is assumed that the dimension H1 of the first and second block wrappers 506, 508 is set to 100 mm and the distance H2 from a roll core end holder of the winding chucks 450*a*, 450*b* to a holder of the rotatable shafts 468*a*, 468*b* is set to one half (50 mm) of the dimension H1 (see FIG. 35). Preferably, $H1 \geqq 2 \times H2$. If the slit width (the width of the roll core 428) of the elongate film 424*a* is 254 mm, then three chuck units 488 are juxtaposed and operated to hold the roll core 428.

At this time, the chuck units 488 on the opposite sides overhang the opposite ends of the elongate film 424*a* by 23 mm. However, inasmuch as the distance H2 from the roll core end holder of the winding chucks 450*a*, 450*b* to the holder of the rotatable shafts 468*a*, 468*b* is set to 50 mm, the chuck units 488 do not interfere with the winding apparatus 430. Consequently, the elongate film 424*a* can reliably be wrapped fully around various roll cores 428 having different axial dimensions.

Figure 44:
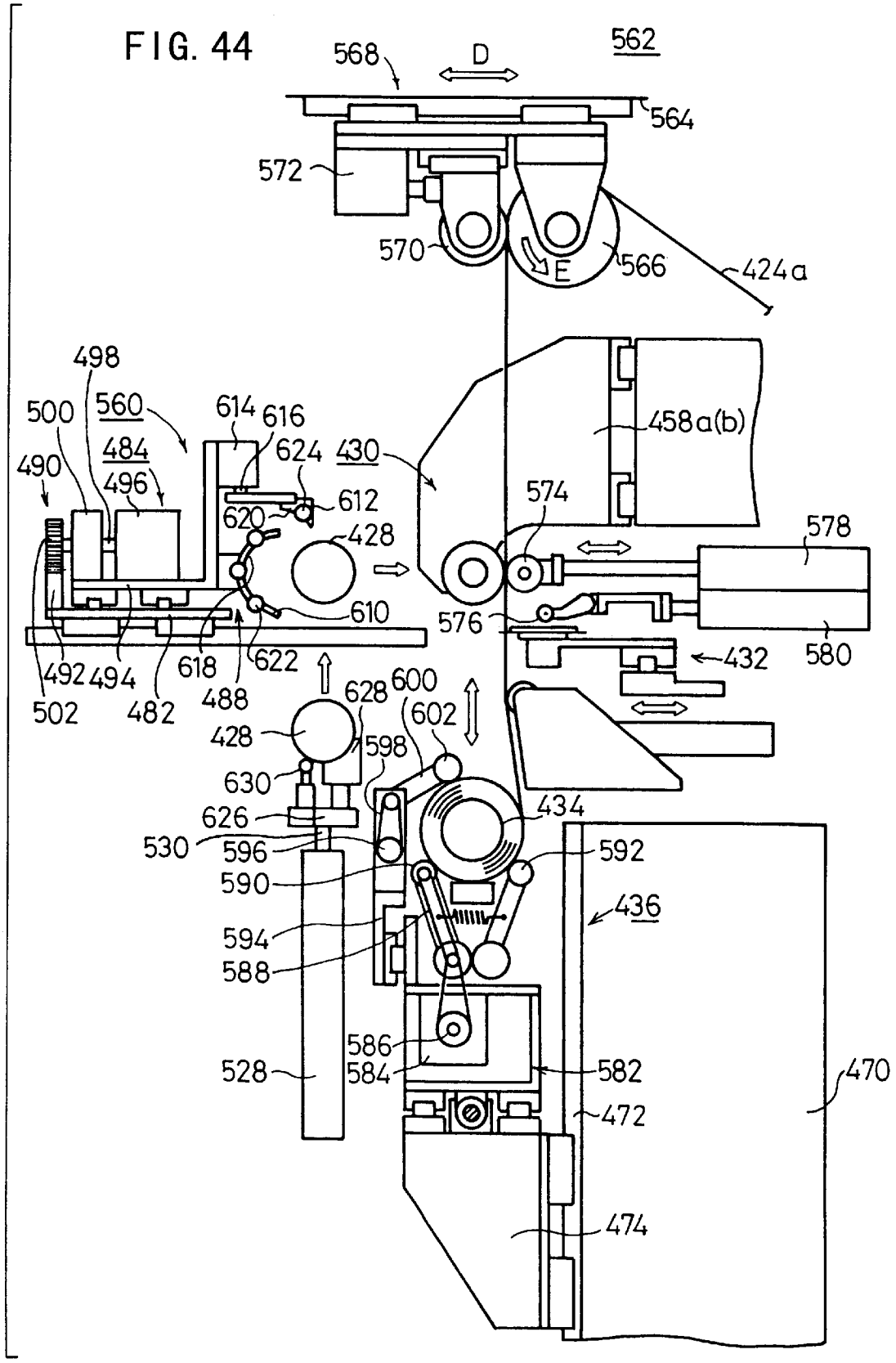
FIG. 44 is a schematic side elevational view of a film cutter which incorporates a film roll core supplying apparatus according to a fourth embodiment of the present invention.

FIG. 44 schematically shows a film cutter (or film rewinder) 562 which incorporates a film roll core supplying apparatus 560 according to a fourth embodiment of the present invention. Those parts of the film cutter 562 which are identical to those of the film cutter 412 according to the third embodiment are denoted by identical reference numerals, and will not be described in detail below.

The film cutter 562 has an upper frame 564 which supports thereon a path roller 566 that is positionally adjustable in the directions indicated by the arrow D by a slide means 568. A rotary actuator (not shown) is coupled to the path roller 566 for rotating the path roller 566 in the direction indicated by the arrow E at a peripheral speed equal to or higher than the speed at which the elongate film 424*a* is fed by the main feed roller (not shown).

A nip roller 570 is positioned for movement into and out of rolling contact with the path roller 566. The nip roller 570 can be moved toward and away from the path roller 566 by a cylinder 572. The slide means 568, which supports the path roller 566 and the nip roller 570 thereon, is positionally adjustable in the directions indicated by the arrow D depending on different (e.g., two) core diameters.

The winding apparatus 430 has a movable nip roller 574 for holding the elongate film 424*a* against the peripheral surface of a new roll core 428 when the elongate film 424*a* is cut off, and a movable guide roller 576 for guiding the end of the severed elongate film 424*a* against the peripheral surface of the roll core 428. The nip roller 574 is operatively coupled to a first drive cylinder 578, and the guide roller 576 is operatively coupled to a second drive cylinder 580.

A main assembly 582 that is movable back and forth in directions across the elongate film 424*a* is mounted on the lifter table 474 of the product discharging apparatus 436. The main assembly 584 includes a torque motor 584 having a drive shaft 586 that is operatively coupled to a tensioning roller 590 by a belt and pulley mechanism 588. Another tensioning roller 592 is positioned in juxtaposed relationship to the tensioning roller 590.

A slide base 594 is mounted on a side surface of the main assembly 582 for movement in directions across the elongate film 424*a*. A motor 596 mounted on the slide base 594 is operatively coupled to a swingable arm 600 by a belt and pulley mechanism 598, and a rider roller 602 is rotatably supported on the upper end of the arm 600.

The chuck mechanism 484 of the supply apparatus 560 has a plurality of chuck units 488 each comprising a fixed first block wrapper 610 and a movable second block wrapper 612. The second block wrapper 612 is supported on a distal end of a rod 616 projecting downwardly from a cylinder 614. The first and second block wrappers 610, 612 have respective first and second curved surfaces 618, 620, partly of an arcuate shape, with rollers 622, 624 rotatably mounted thereon. The rollers 624 are movable toward and away from the roll core 428 and normally urged by a spring (not shown).

A core support base 626 for delivering a roll core 428 to the first and second block wrappers 610, 612 is disposed below the chuck mechanism 484 and is vertically movable by a cylinder 528. A suction box 628 that is connected to a vacuum source (not shown) is mounted on the core support base 626. A support roller 630 is disposed at a lowered position of the core support base 626.

Operation of the film cutter 562 thus constructed will be described below in connection with the supply apparatus 560 according to the fourth embodiment.

Figure 45:
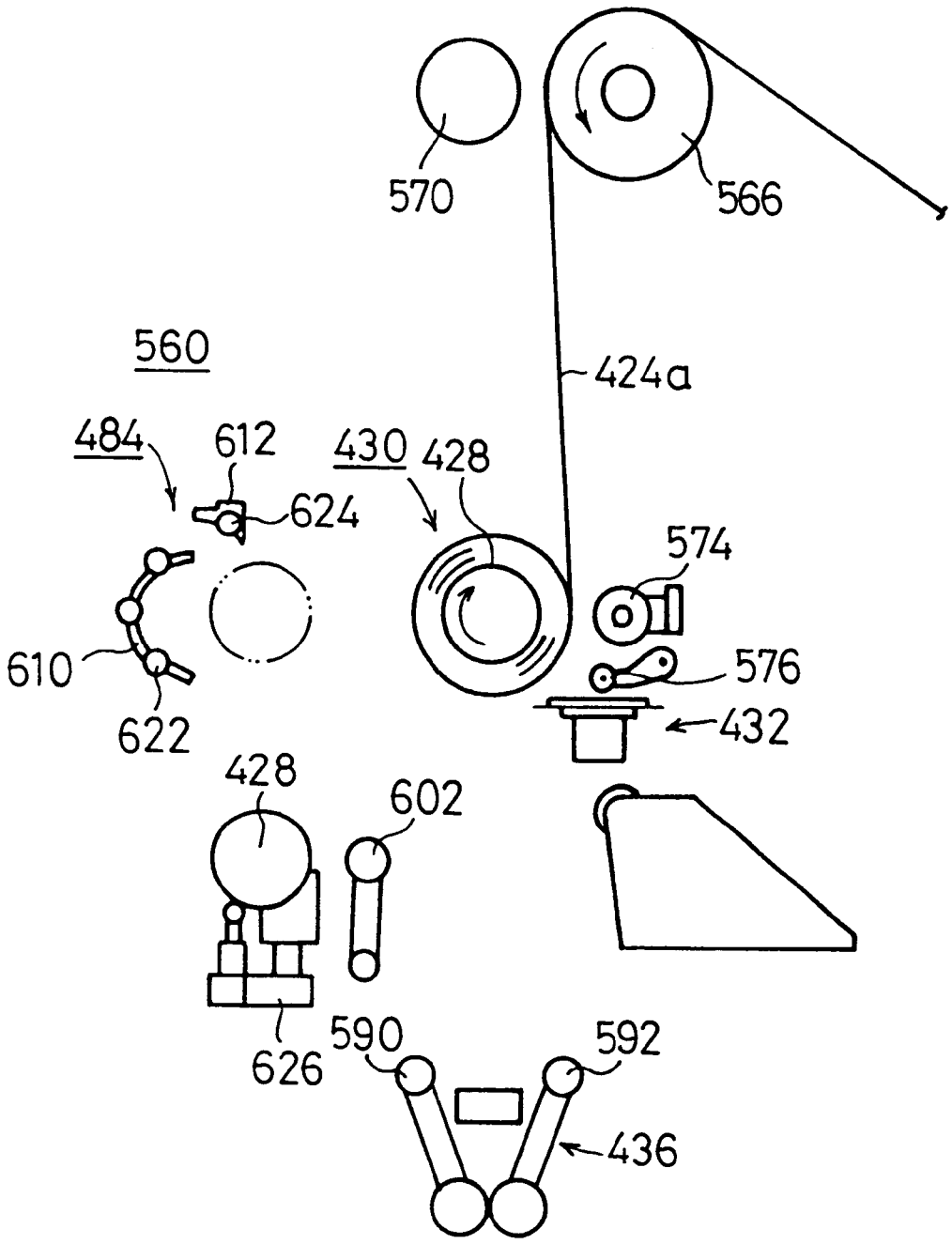
FIG. 45 is a schematic side elevational view showing the manner in which an elongate film is wound around a core in the film roll core supplying apparatus according to the fourth embodiment.
Figure 46:
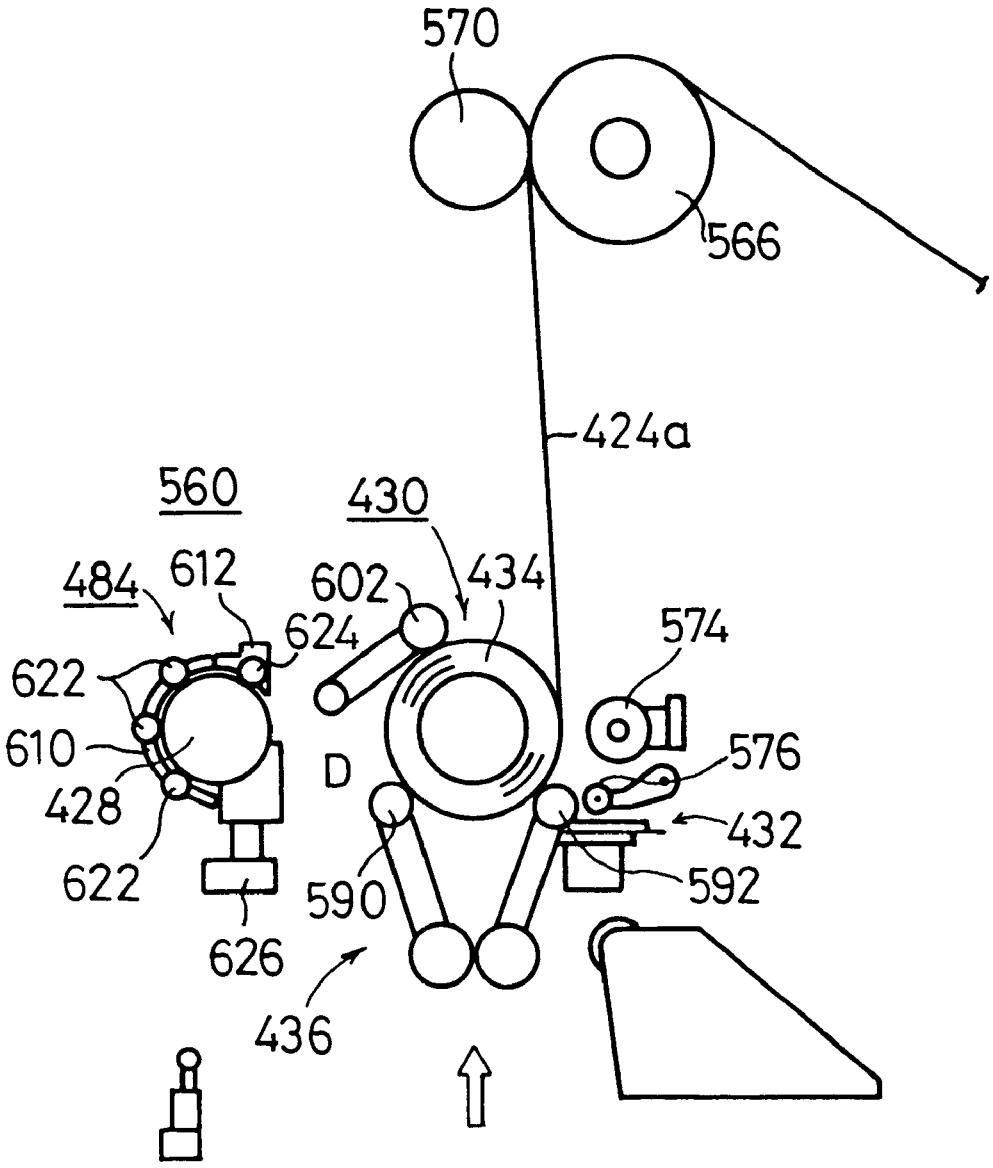
FIG. 46 is a schematic side elevational view showing the manner in which a lifter table is elevated after a film roll has been produced in the film roll core supplying apparatus according to the fourth embodiment.

As shown in FIG. 45, when the elongate film 424*a* is wound to a predetermined length around the roll core 428 by the winding apparatus 430, producing a film roll 434, the lifter table 474 is elevated to cause the rider roller 602 and the tensioning rollers 590, 592 to hold the film roll 434 (see FIG. 46). When the film roll 434 is held by the rider roller 602 and the tensioning rollers 590, 592, the torque of the servomotor 454 has been controlled to impart a certain tension to the elongate film 424*a* of the film roll 434.

Figure 47:
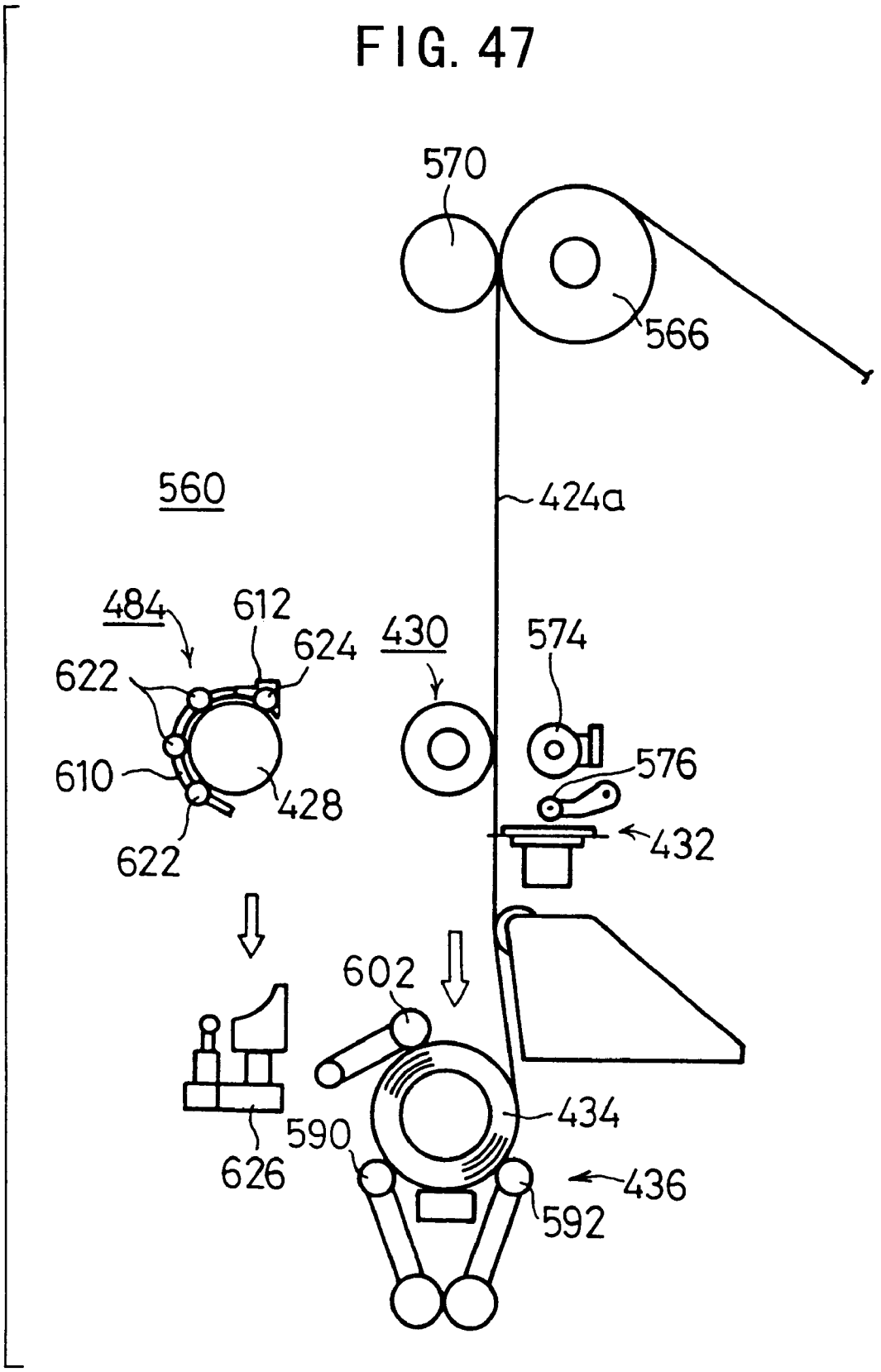
FIG. 47 is a schematic side elevational view showing the manner in which the film roll is lowered in the film roll core supplying apparatus according to the fourth embodiment.

The torque motor 584 is then energized to cause the tensioning roller 590 to tension the elongate film 424*a*. The servomotor 454 is de-energized, and the winding chucks 450*a*, 450*b* are released from the opposite ends of the film roll 434, thereby unchucking the film roll 434. The film roll 434, while being tensioned by the tensioning rollers 590, 592, is transferred to the product discharging apparatus 436, which is then lowered to the product discharging position (see FIG. 47).

As shown in FIGS. 45 and 46, when the elongate film 424*a* is wound around the roll core 428 by the winding apparatus 430, a new roll core 428 is attracted and held by the suction box 628 mounted on the core support base 626, and a lower portion of the new roll core 428 is supported by the support roller 630. The core support base 626 is elevated in unison with the suction box 628, lifting the new roll core 428 to the core receiving position to the core transferring position, after which the new roll core 428 is gripped by the first and second block wrappers 610, 612 of the chuck mechanism 484.

Figure 48:
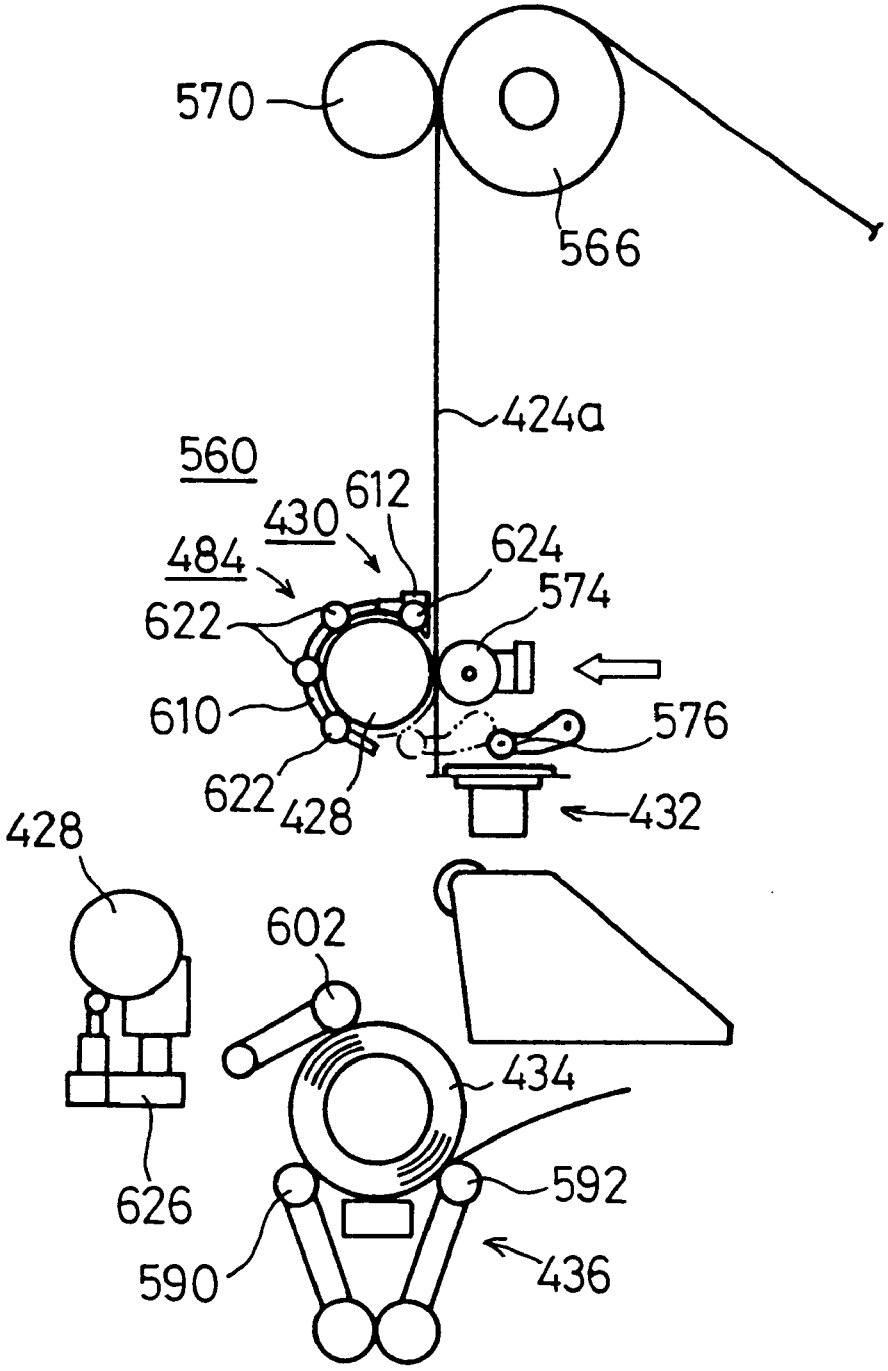
FIG. 48 is a schematic side elevational view showing the manner in which the elongate film of the film roll is cut off.

Then, the elongate film 424*a* is wound to a predetermined length around the roll core 428, producing a film roll 434, which is held and lowered by the product discharging apparatus 436. Thereafter, as shown in FIG. 48, the first and second block wrappers 610, 612 holds a new roll core 428 attracted and held by the suction box 628, and brings the new roll core 428 into the film winding position.

The first drive cylinder 578 is actuated to project the nip roller 574 to hold the elongate film 424*a* against the outer circumferential surface of the roll core 428. The cutting mechanism 432 is actuated to cut the elongate film 424*a* transversely, and the second drive cylinder 580 is operated to move the guide roller 576 toward the roll core 428 for thereby winding the leading end of the elongate film 424*a* around the circumferential surface of the roll core 428.

Figure 49:
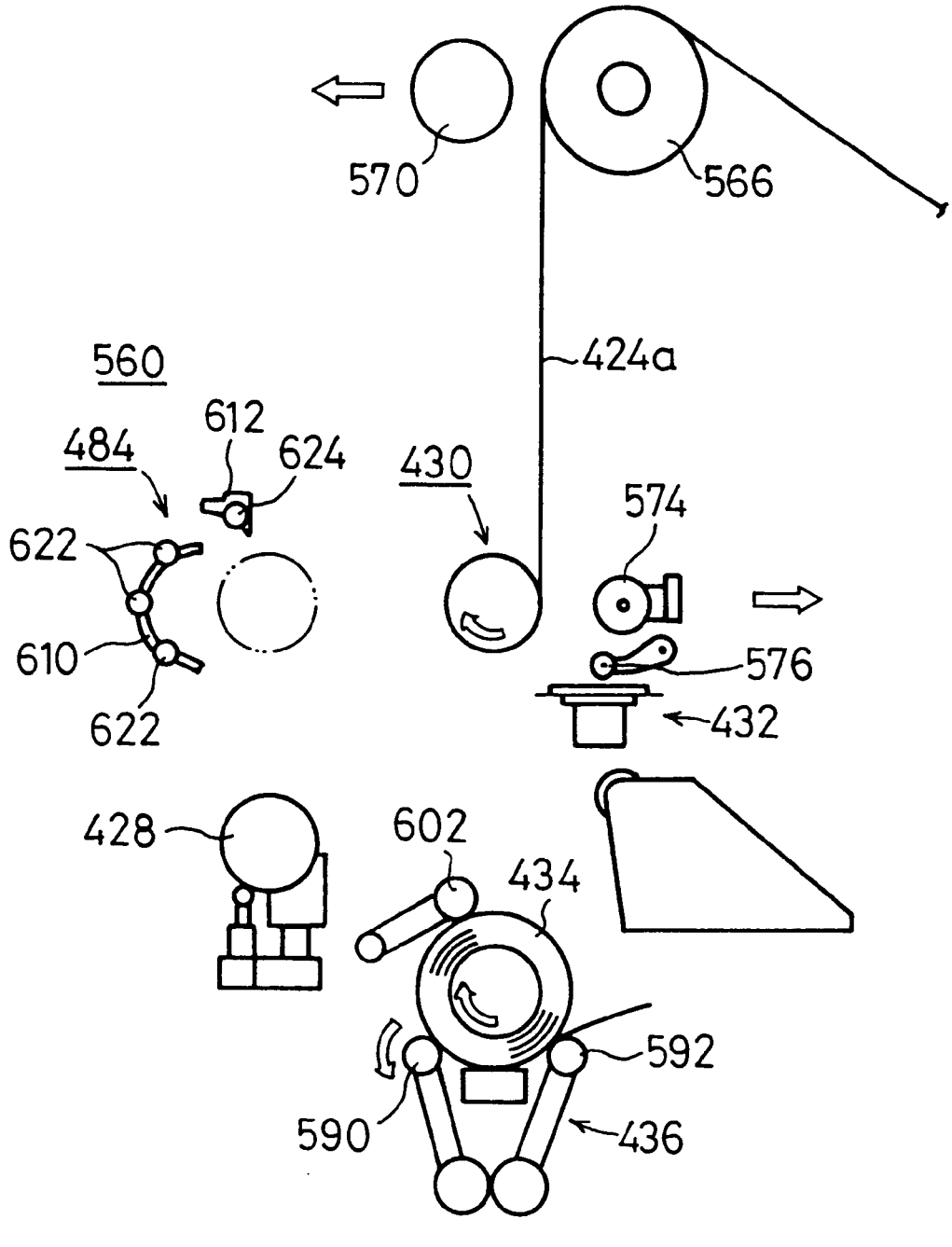
FIG. 49 is a schematic side elevational view showing the manner in which the elongate film is wound around a new core.
Figure 50:
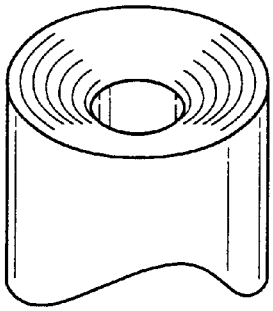
FIG. 50 is a fragmentary perspective view of a rolled film product having a concave conical end face.
Figure 51:
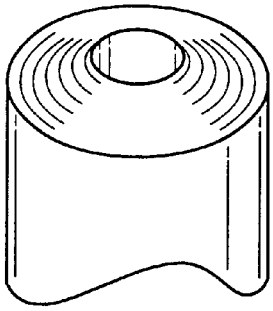
FIG. 51 is a fragmentary perspective view of a rolled film product having a convex conical end face.
Figure 52:
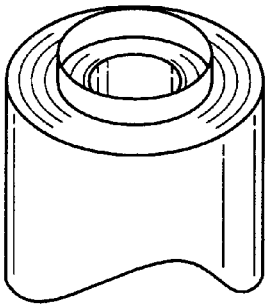
FIG. 52 is a fragmentary perspective view of a rolled film product which has a film layer projecting an end face thereof.
Figure 53:
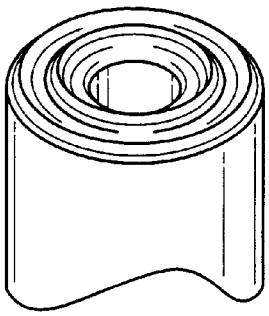
FIG. 53 is a fragmentary perspective view of a rolled film product which has an end face displaced wholly or partly.

The winding apparatus 430 is operated to rotate the roll core 428. After the elongate film 424*a* is wound two or three turns around the roll core 428, the first and second block wrappers 610, 612, the nip roller 574, and the guide roller 576 are retracted, and then the elongate film 424*a* is wound a predetermined length around the roll core 428 (see FIG. 49).

In the fourth embodiment, as described above, the first and second block wrappers 610, 612 of the supply apparatus 560 coaxially hold the roll core 428 fully over its entire length. While the first and second block wrappers 610, 612 is coaxially hold the roll core 428 fully over its entire length in the film winding position, the winding apparatus 430 can rotate the roll core 428. Therefore, the elongate film 424*a* can efficiently and highly accurately be wound around the roll core 428 while reducing as much time loss as possible, as with the third embodiment.

In the method of and apparatus for winding a film according to the present invention, after an elongate film is wound around a roll core, producing a film roll, the film roll is transferred from the film winding mechanism to the product receiving mechanism, and then the elongate film is cut off. During this time, the elongate film is always tensioned. Therefore, the elongate film is prevented from being positionally displaced, and a high-quality film roll can efficiently be produced with a simple process and arrangement.

In the method of and apparatus for supplying a film roll core, while a roll core is being gripped by the openable and closable chuck mechanism which has a centering function, an elongate film is wound to a predetermined length around the roll core by the film winding mechanism. Therefore, the elongate film can efficiently and highly accurately be wound around the roll core while reducing as much time loss as possible.

In the method of and apparatus for inspecting the appearance of a film roll, the appearance of a rolled film product or inspected object (semi-finished product) can accurately be inspected within a short period of time without affecting the quality of a photosensitive material. The efficiency with which to manufacture products of a photosensitive material can therefore be increased.

Although certain preferred embodiments of the present invention have been shown and described in detail, it should be understood that various changes and modifications may be made therein without departing from the scope of the appended claims.

What is claimed is:

1. A method of winding a film, comprising the steps of:

placing a roll core in a film winding mechanism, and thereafter winding an elongate film to a predetermined length around said roll core thereby to produce a film roll;

gripping said film roll tensioned by said film winding mechanism, with a product receiving mechanism, and tensioning a circumferential surface of said elongate film wound around said roll core;

releasing said film roll from said film winding mechanism, and thereafter displacing said product receiving mechanism away from said film winding mechanism while gripping a circumferential surface of said film roll with said product receiving mechanism; and transversely cutting off said elongate film while said elongate film is being tensioned.

2. A method according to claim 1, further comprising the step of:

while holding the circumferential surface of said film roll with a tensioning roller of said product receiving mechanism, displacing said product receiving mechanism away from said film winding mechanism while unwinding said film roll.

3. A method according to claim 1, further comprising the step of:

while holding the circumferential surface of said film roll with a tensioning roller of said product receiving mechanism, displacing said product receiving mechanism away from said film winding mechanism while drawing said elongate film.

4. A method according to claim 1, further comprising the step of:

detecting whether said elongate film is transversely displaced in position or not before said elongate film is wound around a new roll core.

5. A method according to claim 4, further comprising the step of:

if said elongate film is transversely displaced in position, automatically correcting the position of said elongate film.

6. A method according to claim 1, further comprising the steps of:

gripping said roll core with a chuck mechanism having a centering function;

positioning said chuck mechanism in association with said film winding mechanism; and while said roll core is being centered by said chuck mechanism, winding said elongate film to a predetermined length around the roll core with said film winding mechanism.

7. A method according to claim 1, further comprising the steps of:

applying a linear light beam in a wavelength range to which a photosensitive material is insensitive, to at least one inspected surface of the film roll;

imaging a reflected beam from the inspected surface; and inspecting the appearance of the film roll based on the image of the reflected beam.

8. A method of supplying a roll core to a film winding mechanism for rotating the roll core to wind an elongate film around the roll core thereby to produce a film roll, comprising the steps of:

gripping said roll core with a chuck mechanism having a centering function, such that said chuck mechanism directly contacts a circumferential surface of said roll core;

positioning said chuck mechanism in association with said film winding mechanism; and while said roll core is being centered by said chuck mechanism, winding said elongate film to a predetermined length around said roll core with said film winding mechanism.

9. A method according to claim 8, further comprising the steps of:

when opposite ends of said roll core held by said chuck mechanism are gripped by said film winding mechanism, releasing a holding means which immovably fixes said chuck mechanism in an axial direction of the roll core, thereby to allow said chuck mechanism to move in the axial direction of the roll core.

10. A method of supplying a roll core to a film winding mechanism for rotating the roll core to wind an elongate film around the roll core thereby to produce a film roll, comprising the steps of:

gripping said roll core with a chuck mechanism having a centering function;

positioning said chuck mechanism in association with said film winding mechanism;

while said roll core is being centered by said chuck mechanism, winding said elongate film to a predetermined length around said roll core with said film winding mechanism;

if said roll core has a different axial length, positioning of a plurality of chuck mechanisms depending on the axial length of said roll core, in juxtaposed relationship in an axial direction of said roll core; and holding a circumferential surface of said roll core with said plurality of chuck mechanisms.

11. A method of supplying a roll core to a film winding mechanism for rotating the roll core to wind an elongate film around the roll core thereby to produce a film roll, comprising the steps of:

gripping said roll core with a chuck mechanism having a centering function;

positioning said chuck mechanism in association with said film winding mechanism;

while said roll core is being centered by said chuck mechanism, winding said elongate film to a predetermined length around said roll core with said film winding mechanism;

when opposite ends of said roll core held by said chuck mechanism are gripped by said film winding mechanism, releasing a holding means which immovably fixes said chuck mechanism in an axial direction of the roll core, thereby to allow said chuck mechanism to move in the axial direction of said roll core;

if said roll core has a different axial length, positioning of a plurality of chuck mechanisms depending on the axial length of said roll core, in juxtaposed relationship in an axial direction of said roll core; and holding a circumferential surface of said roll core with said plurality of chuck mechanisms.

12. An apparatus for winding a film, comprising:

a film winding mechanism for holding and rotating a roll core to wind an elongate film to a predetermined length around said roll core thereby to produce a film roll;

a product receiving mechanism for gripping said film roll while tensioning a circumferential surface of said elongate film, said product receiving mechanism being displaceable away from said film winding mechanism; and a cutting mechanism for transversely cutting off said elongate film while said elongate film is being tensioned by said product receiving mechanism.

13. An apparatus according to claim 12, further comprising:

a supply apparatus for automatically supplying said roll core to said film finding mechanism.

14. An apparatus according to claim 12, wherein said film winding mechanism comprises:

a movable nip roller for holding said elongate film against the circumferential surface of a new roll core when said elongate film is to be cut off; and a movable guide roller for guiding an end of said elongate film as cut off onto the circumferential surface of the new roll core.

15. An apparatus according to claim 12, wherein said film winding mechanism comprises:

a torque-controllable servomotor for tensioning said elongate film after the elongate film has been wound around said roll core.

16. An apparatus according to claim 12, wherein said product receiving mechanism comprises:

a tensioning roller movable into and out of rolling contact with a circumferential surface of said film roll; and a motor for applying a torque to rotate said tensioning roller.

17. An apparatus according to claim 12, further comprising:

detecting means for detecting whether said elongate film is transversely displaced in position or not before said elongate film is wound around a new roll core.

18. An apparatus according to claim 17, wherein said product receiving mechanism comprises:

automatic correcting means for automatically correcting the position of said elongate film if said elongate film is transversely displaced in position.

19. An apparatus according to claim 12, further comprising:

a chuck mechanism for gripping said roll core in a coaxially centered fashion, said chuck mechanism being movable toward and away from said film winding mechanism;

said chuck mechanism comprising:

a plurality of block bodies for gripping a circumferential surface of said roll core, said block bodies having a predetermined width in an axial direction of said roll core, at least of said block bodies being movable; and a plurality of rollers mounted on said block bodies, for supporting said roll core gripped by said block bodies, rotatably in said coaxially centered fashion.

20. An apparatus according to claim 12, further comprising:

light beam applying means for applying a linear light beam in a wavelength range to which a photosensitive material is insensitive, to at least one inspected surface of the film roll;

imaging means for imaging a reflected beam from the inspected surface; and inspecting means for inspecting the appearance of the film roll based on the image of the reflected beam captured by said imaging means.

21. An apparatus for supplying a roll core to a film winding mechanism for rotating the roll core to wind an elongate film around the roll core thereby to produce a film roll, comprising:

a chuck mechanism for gripping said roll core in a coaxially centered fashion, said chuck mechanism being movable toward and away from said film winding mechanism;

said chuck mechanism comprising:

a plurality of block bodies for gripping a circumferential surface of said roll core, said block bodies having a predetermined width in an axial direction of said roll core, at least one of said block bodies being movable; and a plurality of rollers mounted on said block bodies, for supporting said roll core gripped by said block bodies, rotatably in said coaxially centered fashion.

22. An apparatus according to claim 21, wherein said chuck mechanism comprises:

a plurality of chuck units each having a plurality of said block bodies; and actuating means for moving said chuck units in the axial direction of said roll core.

23. An apparatus according to claim 21, wherein said chuck mechanism comprises:

a chuck unit having a plurality of said block bodies, said chuck unit being movable in the axial direction of said roll core; and holding means for holding immovably said chuck unit in the axial direction of said roll core.

24. An apparatus according to claim 23, wherein said chuck mechanism comprises:

a plurality of chuck units each having a plurality of said block bodies; and actuating means for moving said chuck units in the axial direction of said roll core.

* * * * *